US006234351B1

(12) United States Patent
Wilcox

(10) Patent No.: US 6,234,351 B1
(45) Date of Patent: May 22, 2001

(54) APPARATUS AND METHOD FOR ENHANCING EVACUATION OF BULK MATERIAL SHIPPER BAGS

(75) Inventor: Donald E. Wilcox, Rochester, NY (US)

(73) Assignee: A. R. Arena Products, Inc., Rochester, NY (US)

( * ) Notice: Subject to any disclaimer, the term of this patent is extended or adjusted under 35 U.S.C. 154(b) by 0 days.

(21) Appl. No.: 09/237,819

(22) Filed: Jan. 27, 1999

Related U.S. Application Data

(60) Provisional application No. 60/072,815, filed on Jan. 28, 1998, and provisional application No. 60/072,816, filed on Jan. 28, 1998.

(51) Int. Cl.[7] ..... B65D 35/28

(52) U.S. Cl. ..... 222/95; 222/386.5; 222/389; 383/3; 383/41; 383/109

(58) Field of Search ..... 222/95, 105, 389, 222/386.5, 1; 383/3, 41, 109, 67, 906

(56) References Cited

U.S. PATENT DOCUMENTS

| | | | |
|---|---|---|---|
| Re. 32,232 | 8/1986 | Bonerb et al. . | |
| 2,930,423 | 3/1960 | Cunningham et al. . | |
| 2,956,839 | 10/1960 | Hermanns . | |
| 3,275,197 | 9/1966 | Eklund . | |
| 4,270,533 | 6/1981 | Andreas . | |
| 4,449,646 | 5/1984 | Bonerb et al. . | |
| 4,476,998 | 10/1984 | Bonerb et al. . | |
| 4,673,112 | 6/1987 | Bonerb . | |
| 4,796,788 | 1/1989 | Bond . | |
| 5,096,092 | 3/1992 | Devine . | |
| 5,335,820 | 8/1994 | Christianson . | |
| 5,344,048 | 9/1994 | Bonerb . | |
| 5,489,037 | 2/1996 | Stopper . | |
| 5,494,394 | 2/1996 | Podd et al. . | |
| 5,531,361 | 7/1996 | Podd . | |
| 5,636,764 | 6/1997 | Bonerb . | |
| 5,765,723 * | 6/1998 | Wilcox | 222/1 |

* cited by examiner

*Primary Examiner*—Philippe Derakshani
(74) *Attorney, Agent, or Firm*—Eugene Stephens & Associates

(57) ABSTRACT

A pillow bag is modified to include an air input port that allows inflation of an interply region of the bag. As the interply region inflates, an inner ply rises and becomes an advancing wall, raising the bulk material level in the bag, inclining the bottom of the bag, and pulling excess material away from the drain port all at the same time. In another embodiment, the pillow bag is made with half the initial number of layers folded in half to create the upper and lower plies and the non-fold edges are bonded. Where corner drain ports are used, the bag can be arranged so that an interlayer bond parallel to the fold is parallel to a diagonal of a tote in which the bag sits and so that the interlayer bond is opposite the drain port to enhance bag evacuation. An additional optional feature of the invention is the inclusion of an integral filling conduit or snout on the top of the bag, a mouth of which acts as a fill port to ease filling of the bag. The invention can also be applied to fitted bags.

52 Claims, 16 Drawing Sheets

APPARATUS AND METHOD FOR ENHANCING EVACUATION OF BULK MATERIAL SHIPPER BAGS

This application claims the benefit of U.S. Provisional Application Nos. 60/072,815 and 60/072,816, both filed on Jan. 28, 1998, which provisional applications are incorporated by reference herein.

TECHNICAL FIELD

The invention relates to bags used for shipping bulk materials such as granular materials, powders, liquids, pastes, and other flowable and semi-flowable bulk materials. Specifically, the invention relates to devices and arrangements for evacuating the bags.

BACKGROUND OF THE INVENTION

In the bulk material shipping industry, where plastic bags in totes, such as plastic totes, are used to ship quantities of liquids, pastes, granular materials, powders, and other flowable and semi-flowable bulk materials, substantial quantities of the bulk material can be left in the bag when the bag has been nearly completely evacuated. This is true even where pumps are connected to the drain ports of the bags, and is especially true of more flow-resistant bulk materials, such as drywall paste and mayonnaise. This problem with bulk material shipper bags is created when the bag is evacuated and collapses, which leaves folds of bag material in the tote. When the excess folds are on the bottom near the drain, they can be sucked against the drain port, stalling the pump.

To reduce the amount of bulk material wasted by being left in the bag, prior inventors have tried several approaches. One approach is to incline the bottom of the bag toward the drain port by tilting part or all of the base of the shipping container or even tilting the entire shipping container, plastic tote and all. This approach can be complicated and inefficient since it requires mechanical apparatus to tilt the container if it is not done manually. Additionally, since this approach does little, if anything, to hold the bag in place within the rigid container, the bag can slide when the bottom of the container is tilted. The sliding bag can block the drain port, which prevents removal of further bulk material from the bag and can cause pump stalling.

Another approach is to use a special structure in the bag or in the rigid container to squeeze the residual contents out of the bag. In the case of special structures in the bag, one arrangement stiffens the bag near the drain port using battens or other stiffeners that add to the cost of the bag. Another arrangement adds a special chamber to the bag that can be filled with pressurized air to squeeze the contents from the primary chamber. This arrangement requires the addition of material to the bag solely for the purpose of squeezing the contents of the primary chamber, which increases cost and complexity of manufacture and is inelegant. Additionally, there is no way to prevent pump stalling by excess folds of bag material from blocking the drain port at low bulk material levels. Squeezing the bulk material from the bag in this manner also requires relatively high pressure. To resist the high pressure, reinforced bag material or external pressure-resistant containers must be used that are more expensive than conventional bags and containers.

In the case of special structures in the rigid container, prior inventors have used piston arrangements, rollers, and other external squeezing arrangements. A more passive special rigid container is the pressure-resistant container discussed above. These clearly add significant cost and complexity to the rigid container. Though blockage of the drain port by excess bag material is not as prevalent in these arrangements as it is in arrangements using inflatable chambers, neither is there a way to prevent such blockage.

Another technique for reducing blockage of the drain port is to leave the plunging arrow used to puncture the shipper bag through the drain port extended into the bag. When the bag is evacuated, the plunging arrow presents itself as an obstacle to blockage of the drain port. This delays or reduces the amount of blockage, but a significant amount of bulk material is still left in the bag.

Another prior art device, known as an antivacuum device, can be attached to the drain port to reduce and/or delay blockage of the drain port. The antivacuum device is a cylinder that extends into the bag interior from the drain fitment. A plurality of holes are cut in the sides of the cylinder so that bulk material can flow through the holes if the main opening of the cylinder is blocked by folds of bag material. While this does reduce or delay blockage of the drain port and the amount of wasted bulk material, a significant amount of bulk material is left behind. Additionally, the antivacuum device undesirably increases the cost and complexity of bag manufacture.

A disadvantage of all prior attempts to enhance evacuation of shipper bags and reduce wasted bulk material is that they generally require human intervention during evacuation. Prior arrangements cannot simply be hooked up and allowed to operate until all bulk material that can be has been evacuated. Rather, a human attendant must do something during evacuation to initiate the evacuation enhancement.

With the disadvantages of the prior art, there is a need for a simple, inexpensive, and elegant way to enhance shipper bag evacuation. There is also a need for a liquid shipper arrangement that avoids or at least significantly delays sucking of excess bag material against the drain port of the bag. An enhanced-evacuation shipper bag that does not require human intervention during evacuation is also needed.

An additional problem with pillow-type shipper bags is that they generally lack a filling conduit or snout that would enhance ease of filling the bags. Typically, pillow bags include fitments in their tops for filling the bags through fill hoses that can be connected to the fitments. This arrangement is meant for users who can pump bulk material into the bag through the fill hoses. However, many users either do not want or cannot pump their bulk material and instead pour their bulk material into bags, such as open-top pillow bags and fitted bags equipped with snouts. Open-top pillow bags tend to be more difficult to close than snout-equipped fitted bags and are more susceptible to contamination, but snout-equipped fitted bags are more expensive than open-top pillow bags. In addition, prior attempts to incorporate snouts into pillow-type bags have failed for one reason or another. Consequently, there is a need for a new pillow-type bag that solves the problems associated with shipper bag evacuation as enumerated above and that includes a snout for easy filling of the bag.

SUMMARY OF THE INVENTION

My invention takes advantage of existing shipper bag construction to provide an inflatable chamber that enhances evacuation of shipper bag contents without requiring human intervention during evacuation. In one embodiment, I add an air input port and conduit to the lower half of a pillow bag and opposite the drain port. The input port allows inflation of an interply region between two lower plies of the pillow bag using low pressure air. The air input conduit is preferably connected to a source of pressurized air at the outset of evacuation. The interply region inflates as the bulk material is removed from the bag through the drain port. As the interply region inflates, the inner ply or plies rise near the air input port so that the part beneath the bag contents in that area effectively lifts the fluid and becomes an advancing wall. Unlike prior arrangements, however, the advancing wall doesn't squeeze the bag contents out the drain port. Rather, the advancing wall simply inclines the bottom of the bag a little at a time and raises the level of the bag contents so that the drain port is always completely covered by bulk material. Because the level of the contents is kept above the drain port until very near the end of evacuation, folds of material that collect as the bag collapses float or ride on the surface of the bulk material and do not block the drain port. Additionally, the inner ply is kept taut at all times by the air pressure, pulling the bag material away from the drain port and further preventing or at least significantly delaying drain port blockage. The combination of the drain port and the plumped interply region also holds the bag in place so that it does not slide around in the container if the container is moved.

In another embodiment, I slightly modify the construction of a pillow bag to enhance the performance of the inflatable chamber. Here I use half the initial number of layers of material as in conventional pillow bags, fold them in half to form the upper and lower plies, and bond the non-fold edges of the plies. Depending on particular needs, I can leave the fold unbonded, bond all plies together very near the fold, bond the layers on the fold, or bond one set of plies parallel to the fold at an advantageous location. This adds little to the cost and complexity of manufacture, yet can greatly improve performance of my invention. To enhance performance of this embodiment when it includes a corner drain port, I rotate the bag 45° relative to the tote upon insertion of the bag in the tote so that the bond defining the interply regions is parallel to a diagonal of the tote.

An additional optional feature of my invention is the incorporation of an integral filling conduit, which I prefer to call a snout, into evacuation-enhancing pillow-type bags. I have found a way to include a snout on such pillow bags without significantly increasing cost or difficulty of manufacture. When used in my inflatable, evacuation-enhancing pillow bag, I prefer to form seals between the plies of the bag: one along the side(s) of the bag opposite the drain port and one along the side(s) including (and nearest to) the drain port. The seal opposite the drain port is preferably formed at a point on the side of the bag below the snout. The amount of bag material leading to the drain on either side of the seal is preferably substantially equal, though the exact position can vary depending on the particular application. The other seal is at the midpoint of the bag. The air input port is formed just below the seal opposite the drain. The result of this configuration is a minimization of bulk material left in the bag when no more bulk material can be discharged, significantly increasing the amount of bulk material evacuated from the bag, thus saving the user bulk material, time, and money. I take two or more rectangular layers of material and bond their edges into a shape that will yield a bag with a snout, such as a rectangle with the long base of a trapezoid on one side. Flaps of material are left next to the sides of the trapezoid, and I cut these off to facilitate handling and filling of the bag. Alternatively, I can use one or more rectangular layers of material folded in half, then bond their edges along the sides to form the same trapezoid/rectangle shape. In this alternative, the fold lies on the side of the rectangle opposite the long base of the trapezoid and may not need to be sealed, depending on the particular application and the desires of the user. A drain can be included in one side of either variation of the bag to allow discharge of the bag's contents.

With the sides of the evacuation-enhancing snout bag thus sealed, it is ready for use. As with the other forms of my evacuation-enhancing pillow-type bulk material shipper bags, I position the bag in a rigid container, such as a plastic shipping tote, so that the seams lie at the midpoints of opposing sides of the container. Alternatively, I can position the bag so that the seams lie in the corners of the tote, depending on the particular needs of the user. The position of the seams must be taken into account when making the bag, however, to ensure adequate material for proper sizing of the bag. With the bag positioned as desired, I then attach the snout to a source of bulk material, preferably using a spanner bar, and fill the bag. When the bag is full, I remove the snout from the spanner bar (if used), tie it off, and ship it. My invention thus provides a much less costly snout bag than prior art arrangements.

All of my embodiments overcome all the disadvantages of the prior art discussed above. I enhance evacuation of the bags while keeping costs low and achieving a level of elegance of use. An additional benefit is that, when the interply region is substantially fully inflated, a portion of the bag rises out of the rigid container and acts as an indicator that the bag is empty. My bag and system can be used in any system that uses bags in rigid or semi-rigid containers using a bag with at least two plies, including any bulk material shipping system using, for example, closed-top pillow bags, open-top pillow bags, and fitted bags, that have a drain port in, at, or near the bottom of the container, though a drain port is not necessarily required. I do not employ external bladders, tilting bottoms, stiffening battens, or a pressure-resistant outer container as do prior art devices. Instead, I take advantage of the structure of the bags to form an inflatable air chamber between the plies of the bags using edge and other seals, bonds, or seams, the air chamber extending beneath some or all of the contents of the bag. My invention can be used with liquids, powders, pastes, or any other suitable bulk materials. Additionally, evacuation enhancement occurs automatically as bag contents level decreases so that no human intervention is required between setup and take down of the bag.

DESCRIPTION OF THE INVENTION

Figure 1A:
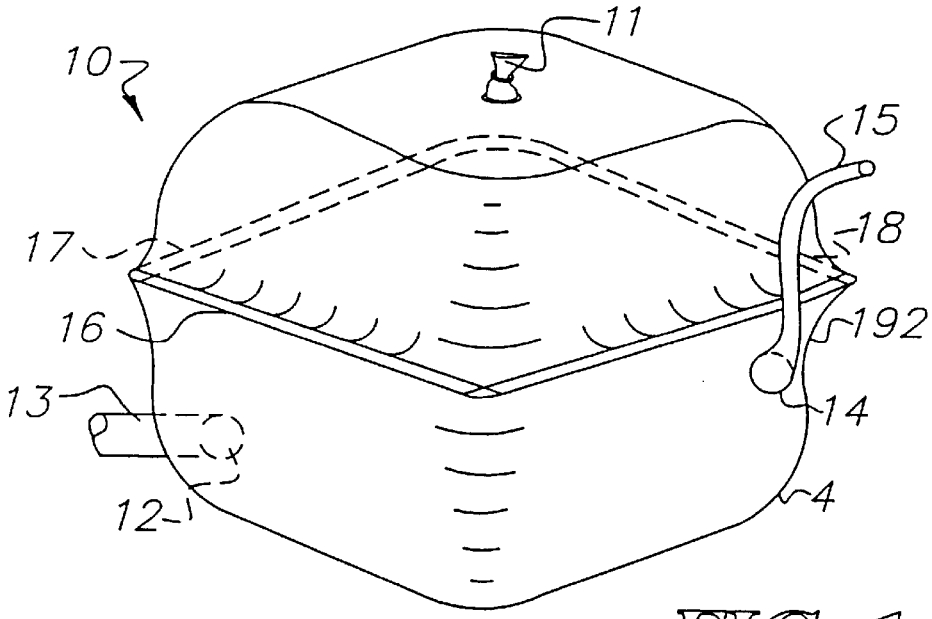
FIG. 1A is a schematic view of a filled pillow bag according to an embodiment of the invention.

My invention can be applied to most bulk material shipper bags including closed pillow bags, snorkel-top pillow bags, open-top pillow bags, and fitted bags. Bulk material shipper bags commonly include at least two edge seals (heat seal, tie off, or other type) on opposite sides or ends of the bag. Optionally, they can have a seal around the full perimeter of the bag. In my case, I prefer to form seals down the edges of the layers of material used to make the bag. I add a third seal to connect the two edge seals, if such a third seal is not already present. This third seal can be another edge seal or an internal seal or interply bond through the plies on one side of the bag. The seal should be placed roughly opposite the drain port at a distance of one half the smallest dimension of the container or more away from the drain port. The third seal should also be somewhere above the floor of the container, preferably at or above the midplane of the container.

A fourth seal completes an inflatable air chamber in the interply region, and I add a fourth seal if it is not already present. One way to form the fourth seal is to use the weight of the bag contents, such as by placing the fold on the bottom of the container, so that the contents hold the plies together in a quasi-seals. Alternatively, a physical seal can be formed connecting the two edge seals positioned under the contents or on the opposite side of the contents from the third seal. Other seals can also be employed, or the seals can be combined into one or more continuous seals, but the four seals discussed above are the minimum required. The connection to the air chamber can be made at any point in the air chamber, but the air chamber inflates sooner and grows larger if the connection is made higher in the container.

Referring to the accompanying Figures and using closed-top pillow bags as an exemplary embodiment, my invention comprises a multiple-ply bag 10 that is formed with an air input port 14 and an air input conduit 15 that allow air 6 from a source of pressurized air 2 to enter an inflatable air chamber formed in an interply region 204, 205 of the bag 10, lying between an outer ply 202, 212 and an inner ply 201, 211, when certain conditions are met. The bag 10 is preferably of the pillow type and can be made with some variations, though my preferred embodiment shows the best performance. In all cases, a fill port 11 is included through the upper plies 24 and I prefer that a drain or exit port 12 be formed in the lower plies 25 in a manner consistent with the state of the art to allow appropriate connections to be made while preventing leakage. For closed-top pillow bags, the fill port 11 includes a fitting onto which a cap can be placed to seal the bag after filling. For snorkel-top bags, the fill port 11 is the opening of the snorkel and must be held open with a spanner bar on a fill head until the bag is filled, at which point the spanner bar is removed and the snorkel is tied off to close the bag. For open-top bags, the fill port 11 is simply the opening left by the absence of a top. For closed-top bags, I prefer to have the fill port 11 centrally located in the upper plies 24 so that it sits in the center of the top of the filled bag 10. While the drain port 12 can be formed anywhere in or near the bottom 4 of the bag 10, I prefer to form the drain port 12 so that it will sit near the bottom 4 in one of the sides of the filled bag 10. While I show the bag 10 as having two upper plies 24 and two lower plies 25, my invention can be used in a bag 10 that uses more plies. Also, while I show the plies as being rectangular, they can have any suitable shape that allows my invention to perform in a satisfactory manner. Where I speak of bonds and seams, these can be made in any manner consistent with the art, though I prefer to use heat sealing to create the bonds and seams for simplicity of manufacture and cost reduction. Further, the terms "upper" and "lower" are not meant to limit the orientation of the bag in use but are used to aid in the description of the exemplary embodiment.

Figure 20:
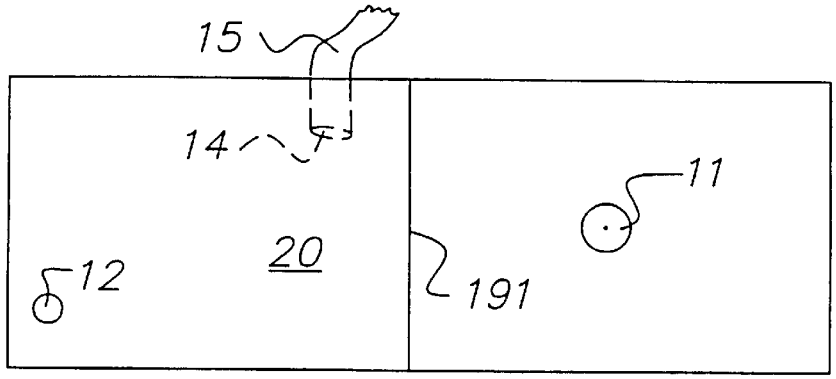
FIG. 20 is a schematic top view of two layers of material used to make the invention according to an aspect of the invention yielding the bag shown in FIG. 1A.
Figure 23:
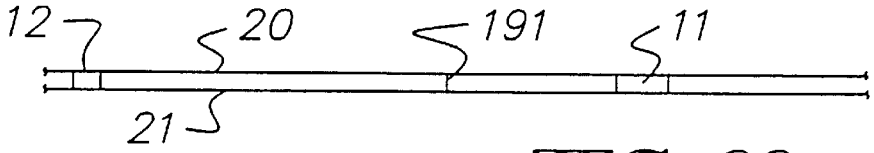
FIGS. 23–25 are schematic side views of the layers shown in FIGS. 20–22.
Figure 25:
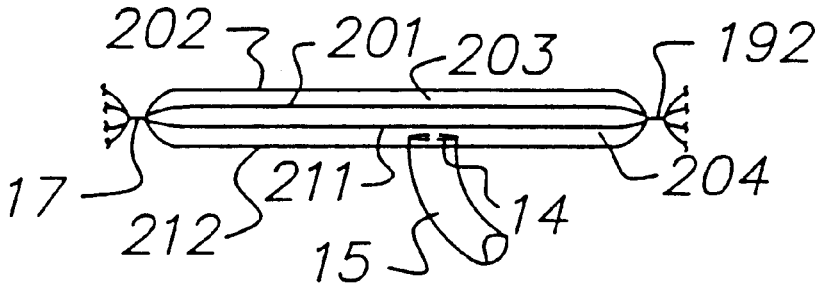
Figure 26:
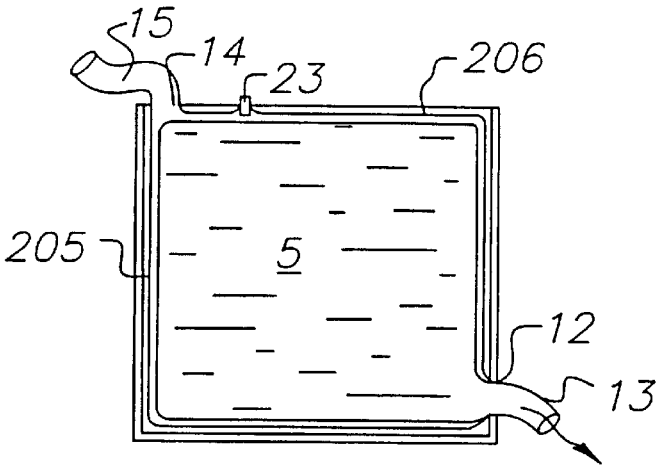
FIGS. 26–31 are schematic side views of the invention in use illustrating the manner in which the interply regions inflate as bag contents are evacuated.
Figure 27:
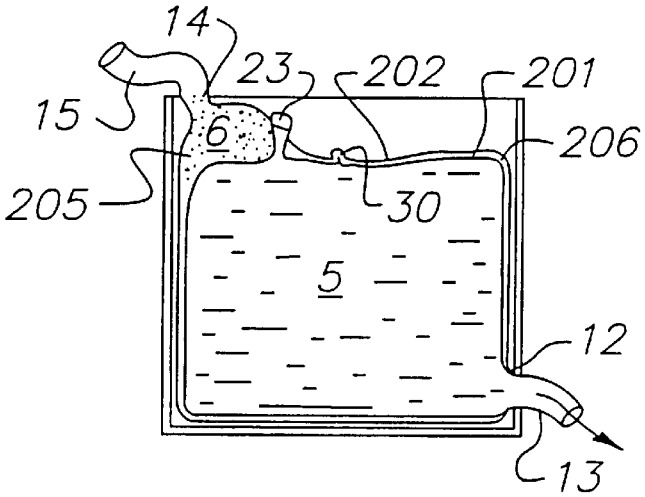
Figure 28:
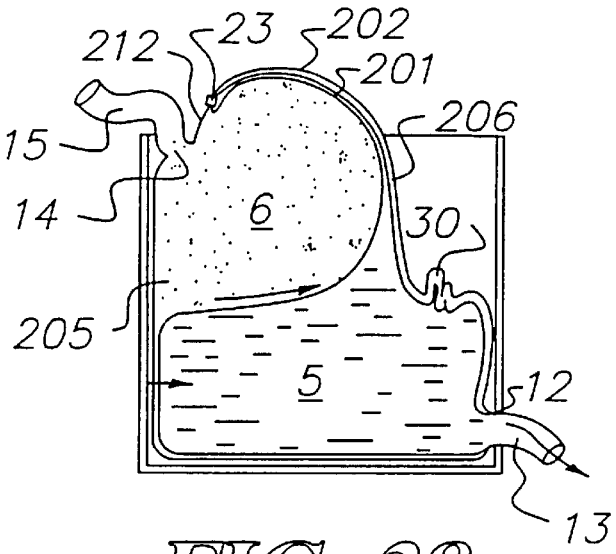
Figure 29:
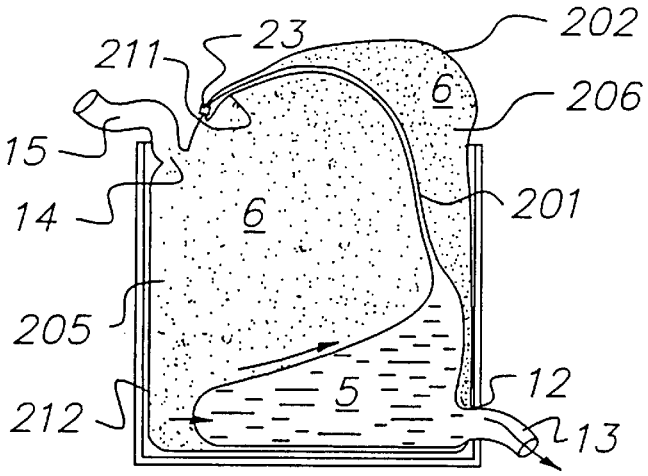
Figure 30:
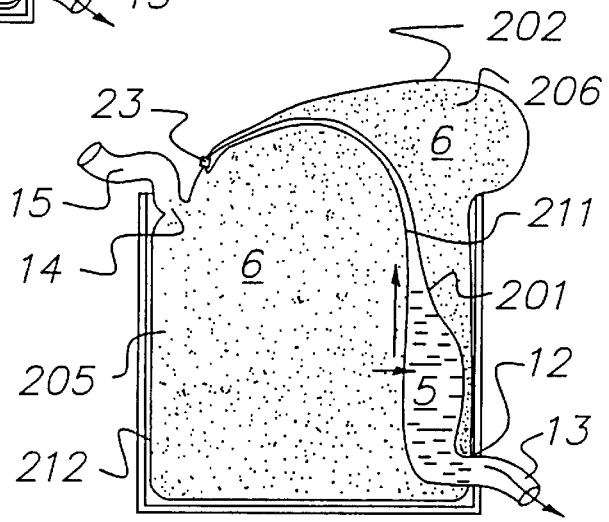
Figure 31:
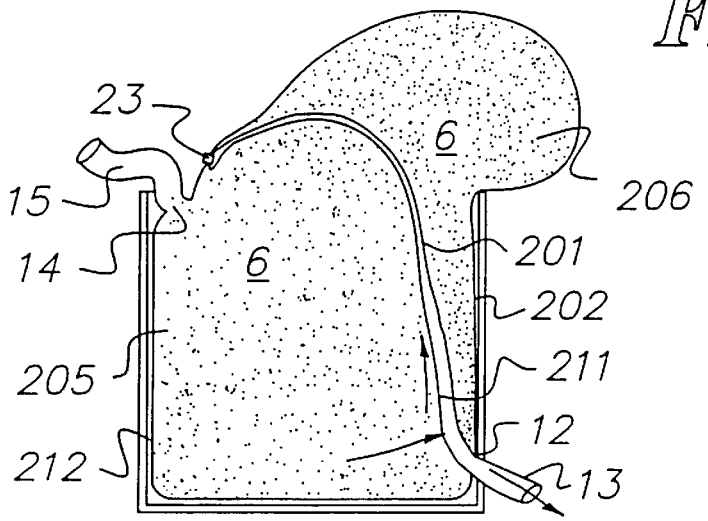
Figure 33:
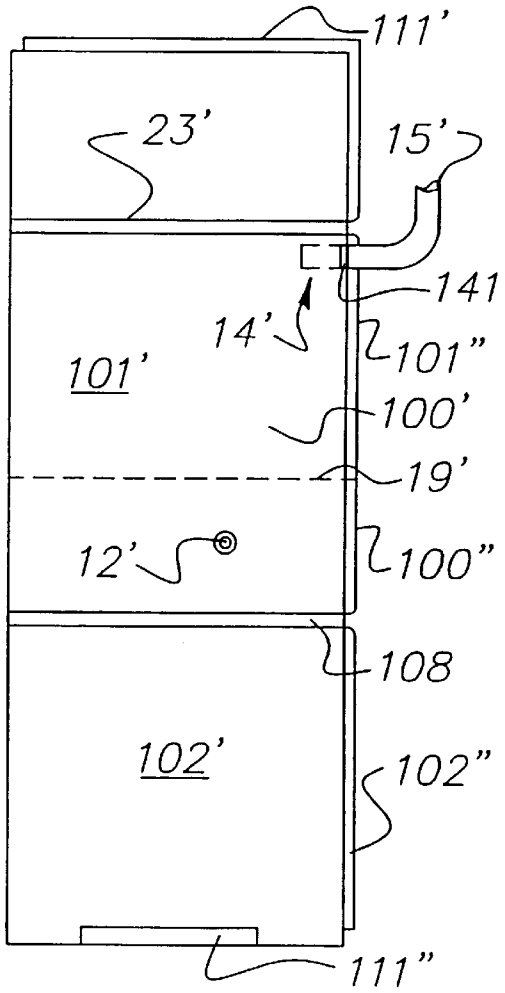
FIG. 33 is a top schematic view of two exemplary pieces of material used to form a two-ply version of the invention shown in FIG. 32.
Figure 32:
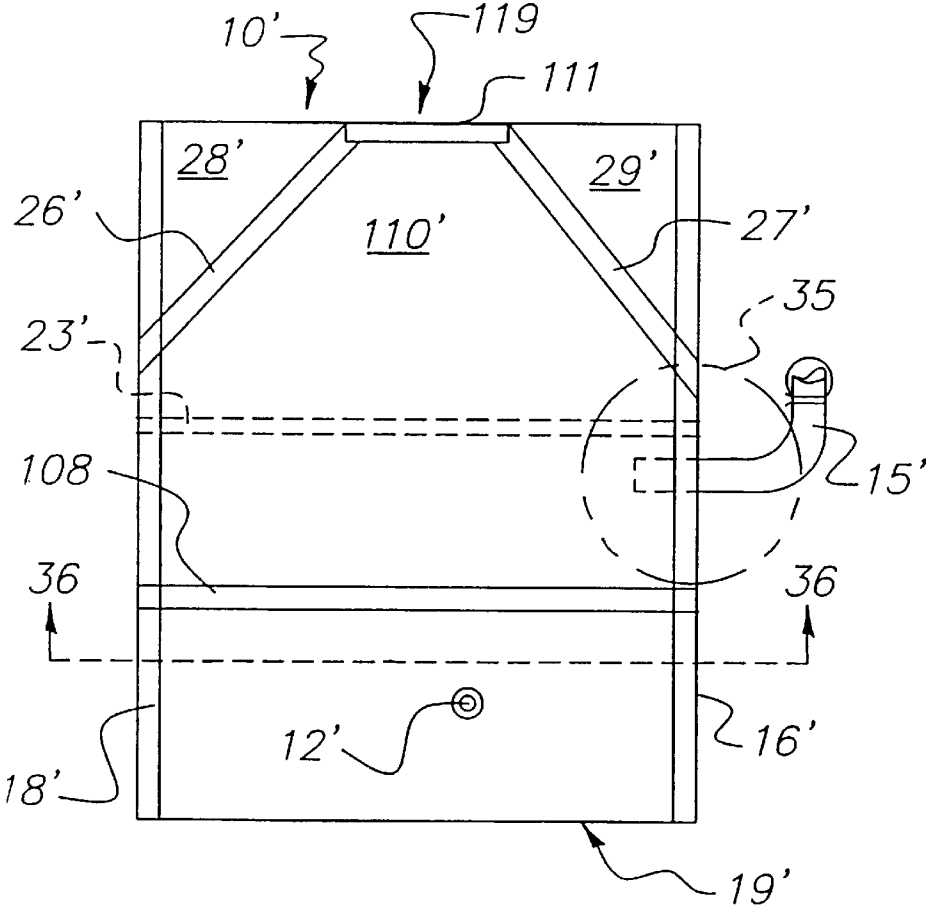
FIG. 32 is a schematic front view of the pillow bag form of the invention with an integral fill conduit according to another aspect of the invention.
Figure 34:
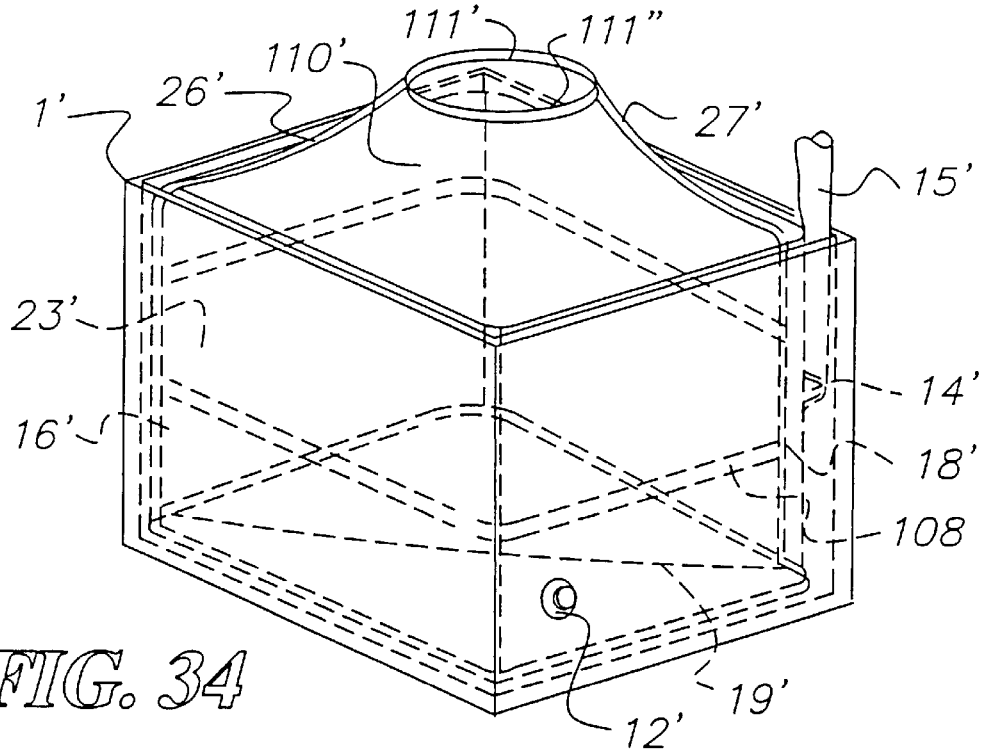
FIG. 34 is a schematic view of the bag of FIGS. 32 and 33 as it appears when filled.
Figure 35:
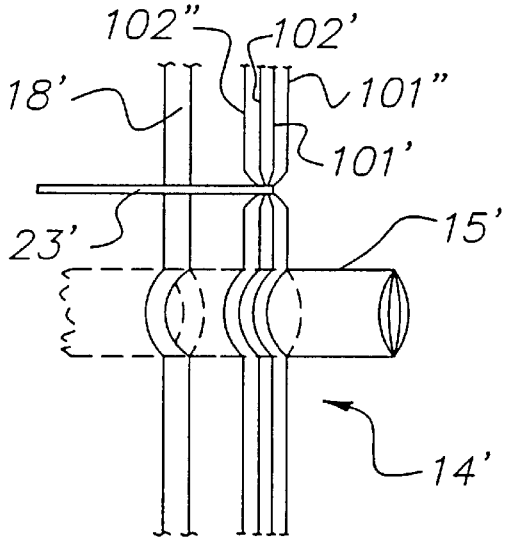
FIG. 35 is a close-up of the air input conduit of the bag of FIGS. 32–34.
Figure 36:
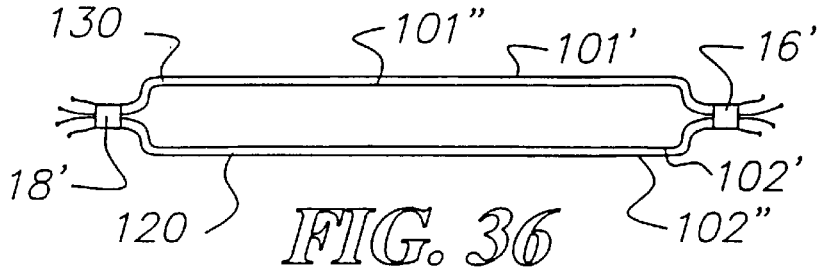
FIG. 36 is a cross section of the bag of FIG. 32 taken along the line 36—36.

In one form of my invention, best seen in FIGS. 1A, 3–6, 20, 22, 23, and 25, I form the bag 10 by taking four layers of plastic and bonding their edges together to form seams 16–18 and 192. The four layers can be made from two rectangular layers 20, 21 cut in half as shown in FIGS. 20 and 23 and stacked as shown in FIG. 25. The top two layers become upper plies 24 of the bag 10 and carry the fill port 11. The other two become lower plies 25 of the bag 10 and carry the drain port 12. The seams 16–18 and 192 form an equator seam of the bag 10 that seals an upper interply region 203 between the upper plies 24 of the bag 10 from a lower interply region 204 between the lower plies 25 of the bag 10. The equator seam is the equivalent of the four seams discussed above. The air input port 14 in this embodiment is formed in the lower plies 25 and allows access to the lower interply region 204. I prefer to form the air input port 14 by placing it between the lower plies 25 across what will be one of the seams before the plies are bonded as shown in FIG. 5B. Alternatively, the input port 14 can be cut from the outer ply 212 as shown in FIG. 5A and can include a fitting similar to that used in drain ports in the art.

The air input port 14 can be kept sealed using a piece of air-tight flexible material, such as plastic film, and another piece of material, such as an elastomeric band, to hold the air-tight material on the air input port 14. The outside end of the air input port 14 can include a fitting for easier attachment of the air input conduit 15. The air input port 14 itself can be constructed from one or more plies of the same material used to make the bag 10. Where more that one ply are used, the plies should be bonded together at the ends of the air input port 14. In use, the air input conduit 15 can be held on the air input port 14 using an elastomeric band because of the low pressures within the joint between the air input port 14 and the air input conduit 15.

In a variation of the first embodiment best seen in FIGS. 20–25, I form the pillow bag 10 from two layers 20, 21 of material cut into rectangles and fold the layers 20, 21 in half to form four rectangular plies 201, 202, 211, 212. As they appear in the FIGS., the left halves of the layers 20, 21 become the lower plies 25 and carry the exit port 12, while the right layers become the upper plies 24 and carry the fill port 11. After folding the layers 20, 21, I bond the non-fold edges of the plies together to form seams 16–18 which make a partial equator seam on the bag 10. Here, opposing seams 16, 18 are the first and second seams discussed above, and the intermediate seam is the second seam. The fold side 19 of the bag 10 can be treated in one of three ways: the layers of material can be bonded to each other along the fold 19 in an interlayer bond 191; the layers can be bonded at the fold so that a seam or interply bond 192 can be formed with all four plies along or near the fold; or the layers can be bonded parallel to the fold in a top interlayer bond 23, but some distance away from the fold 19. Any of these three treatments of fold side 19 is the equivalent of the fourth seam discussed above.

Figure 1B:
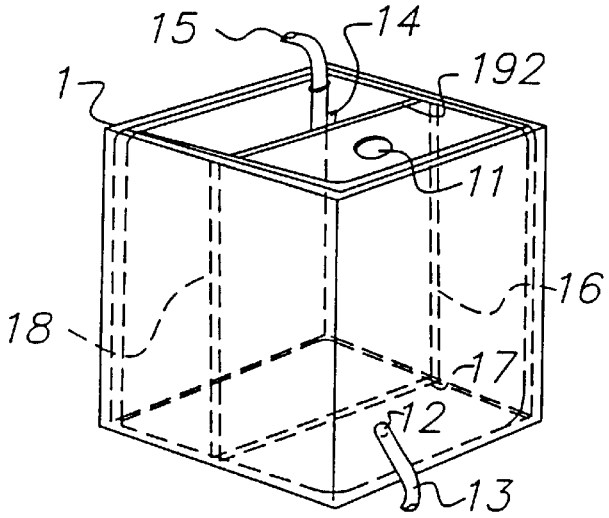
FIGS. 1B and 1C are schematic views of the bag of FIG. 1A in alternative orientations.
Figure 1C:
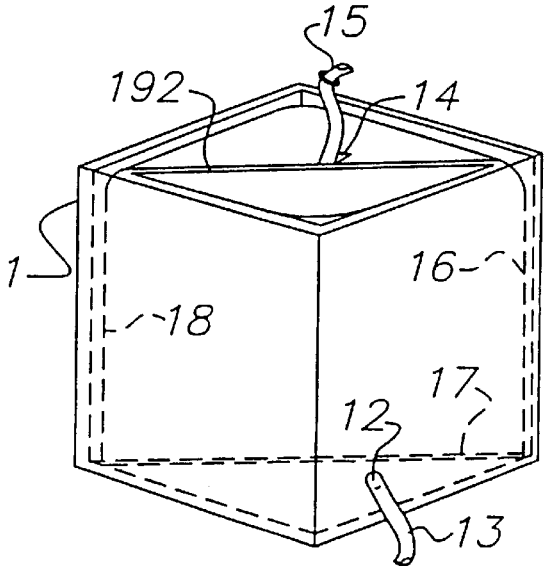
Figure 1D:
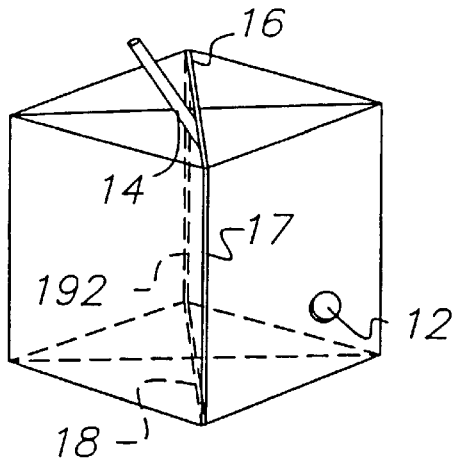
FIGS. 1D and 1E are schematic views of the invention applied to a fitted bag in different orientations.
Figure 1E:
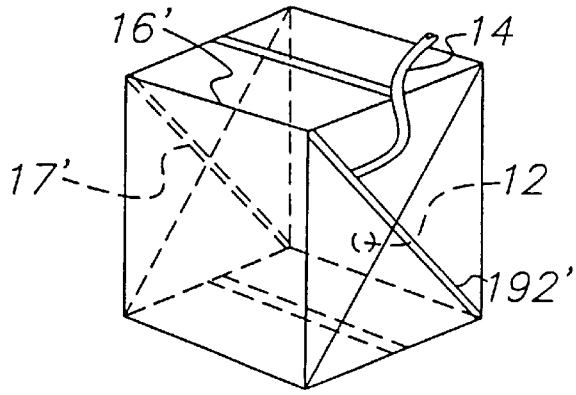
Figure 2A:
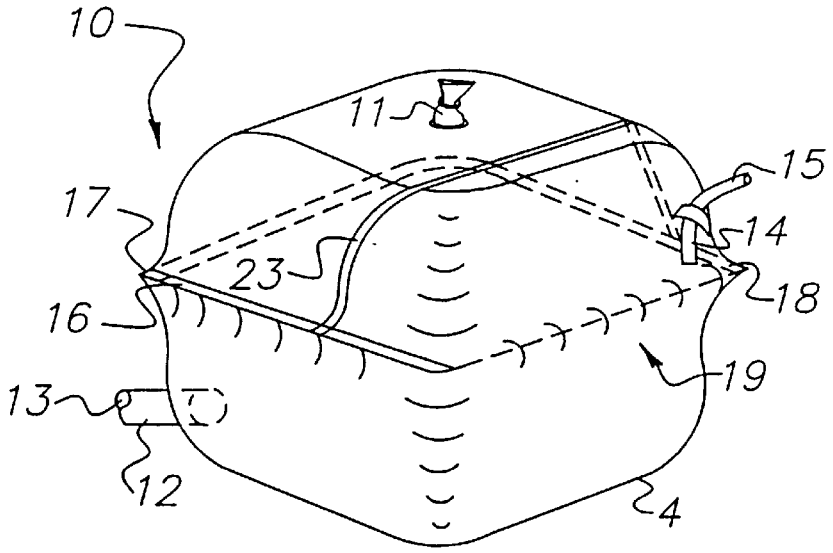
FIG. 2A is a schematic view of a filled pillow bag according to another embodiment of the invention.
Figure 2B:
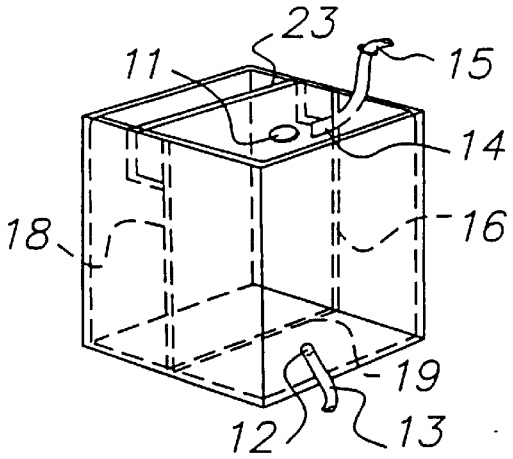
FIGS. 2B and 2C are schematic views of the bag of FIG. 2A in alternative orientations.
Figure 2C:
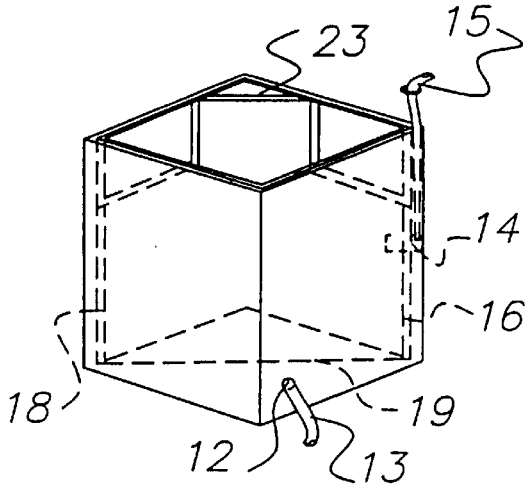
Figure 3:
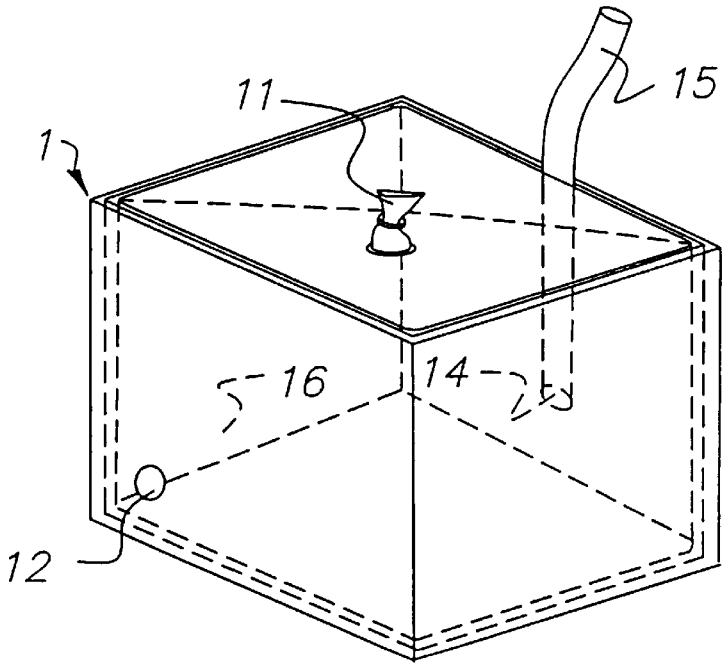
FIG. 3 is a schematic view of the pillow bag of FIG. 1A filled and in a plastic shipping tote according to one aspect of the invention.
Figure 5A:
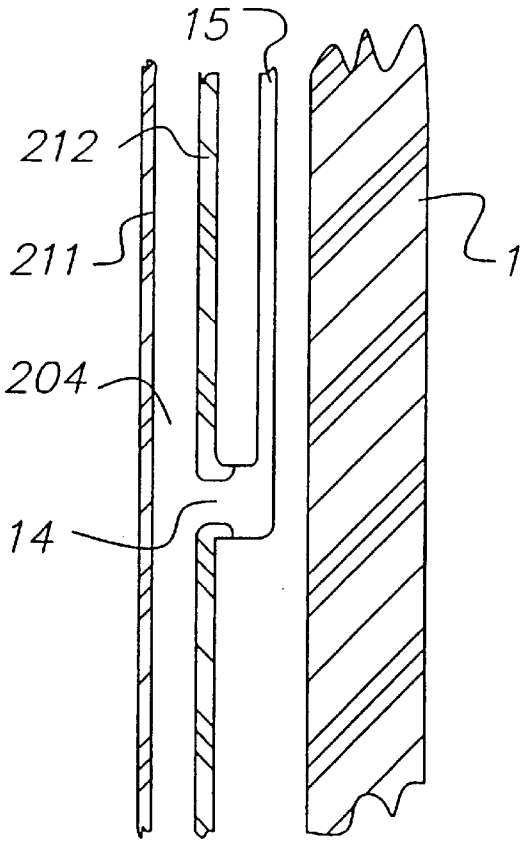
FIG. 5A is an enlarged schematic view of the juncture of the air input port and air input conduit shown within the dashed circle area in FIG. 4.
Figure 4:
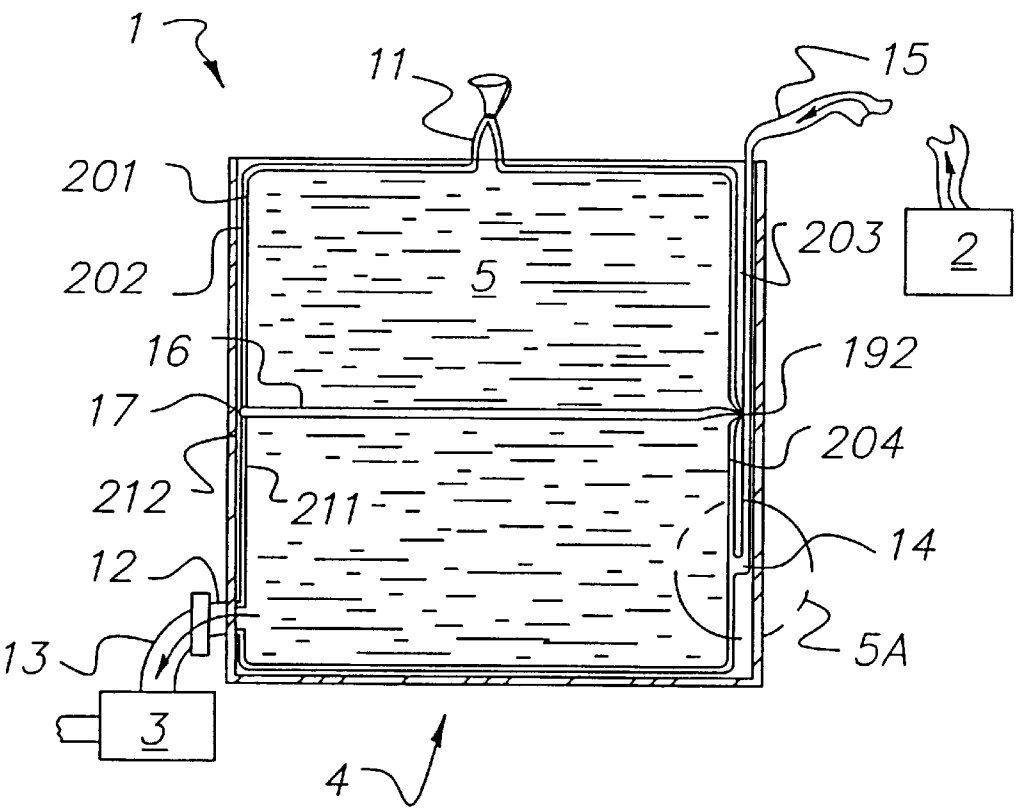
FIG. 4 is a cutaway schematic view of the filled bag and plastic tote of FIG. 3.
Figure 6:
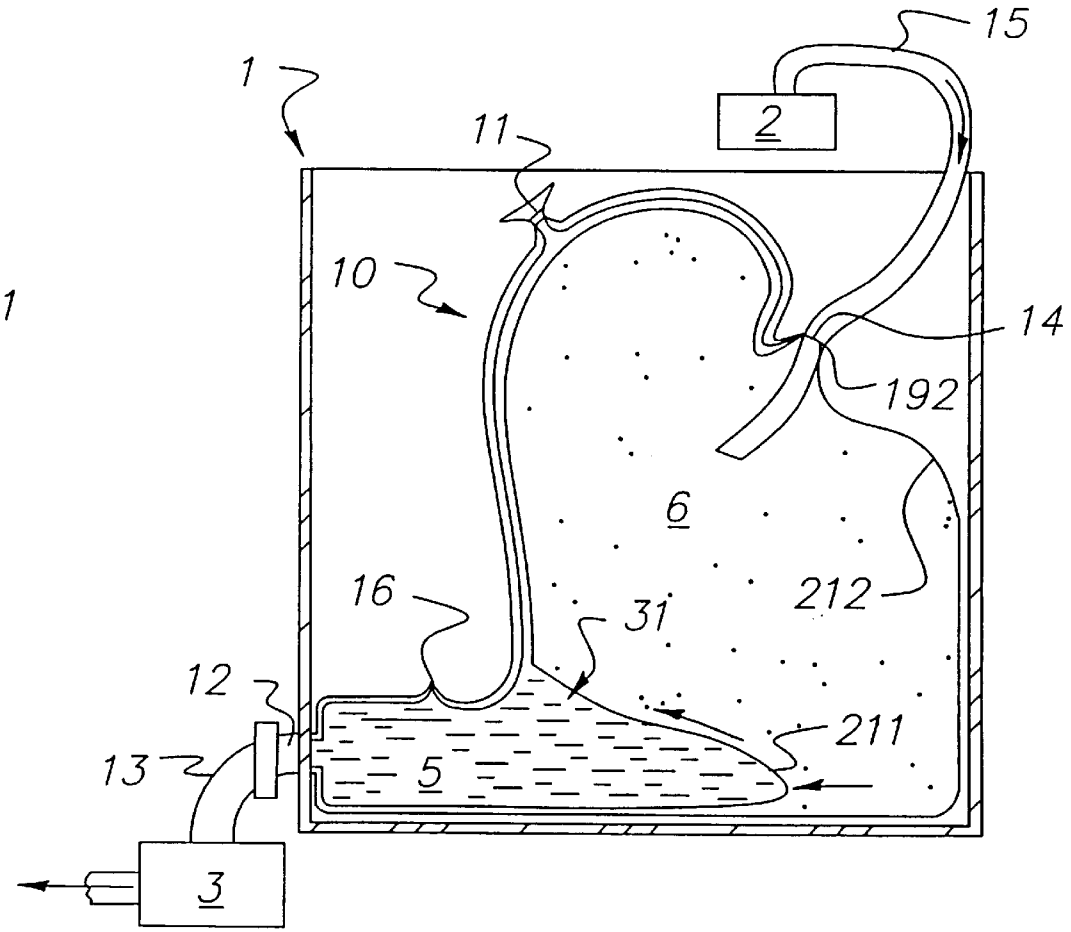
FIG. 6 is a cutaway schematic view of the bag and plastic tote of FIG. 4 after a substantial portion of the contents of the bag have been evacuated and the interply region has inflated.
Figure 5B:
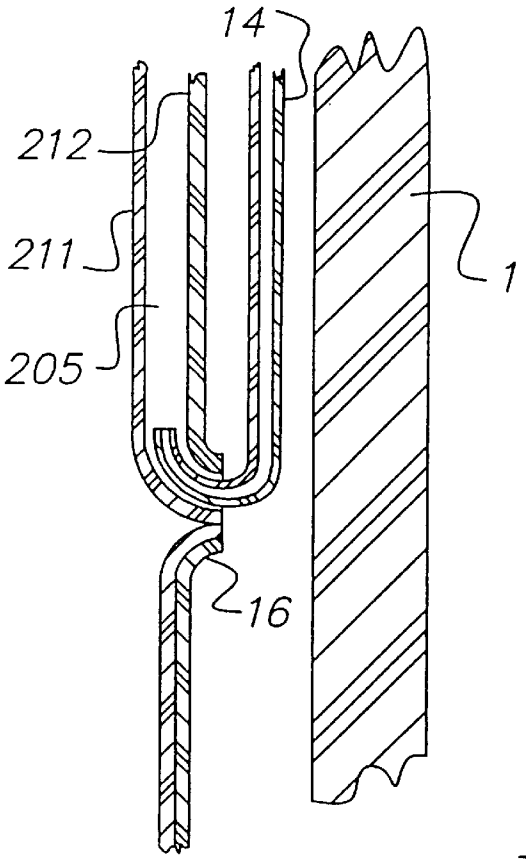
FIG. 5B is an enlarged schematic view of the juncture of the preferred air input port and the bag as shown in FIG. 8.
Figure 8:
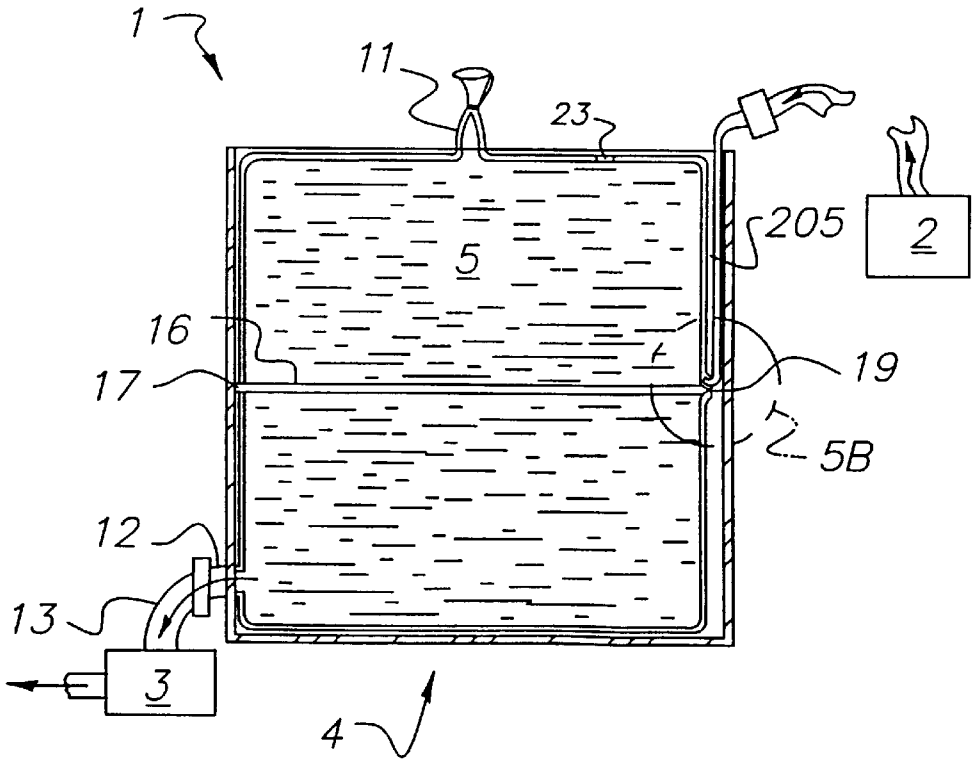
FIG. 8 is a cutaway schematic view of the filled bag and plastic tote of FIG. 7.
Figure 7:
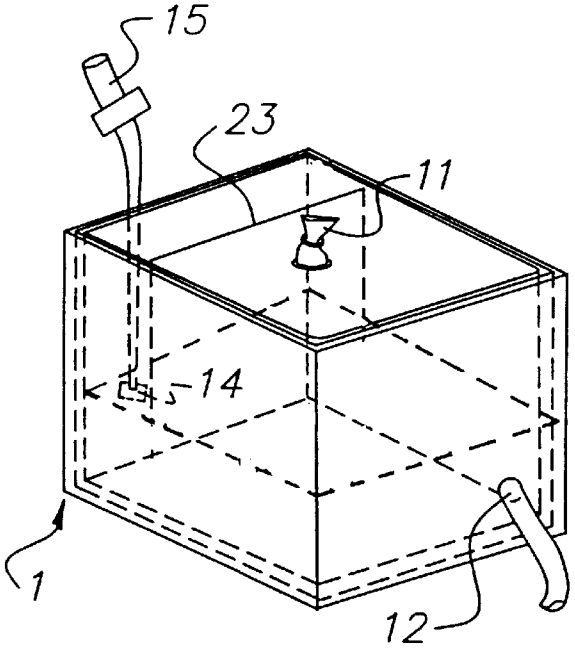
FIG. 7 is a schematic view of the pillow bag of FIG. 2A filled and in a plastic shipping tote according to an aspect of the invention.
Figure 21:
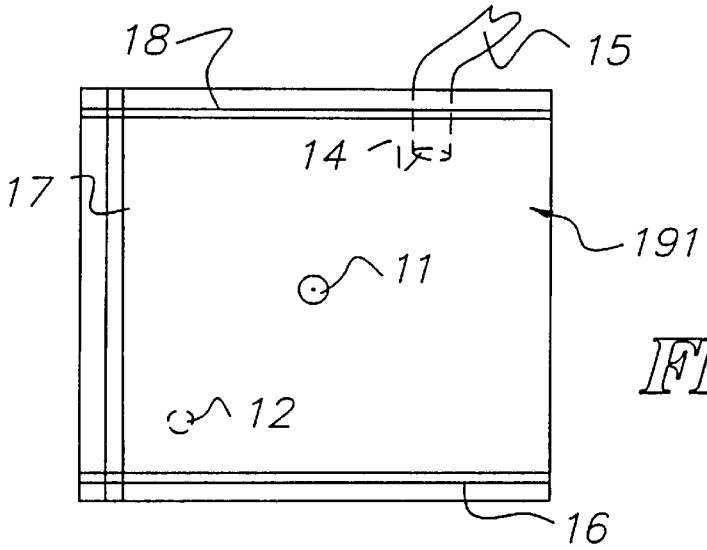
FIG. 21 is a schematic top view of the layers of FIG. 20 after they have been folded or cut and stacked and the non-fold or non-cut edges have been bonded.
Figure 24:
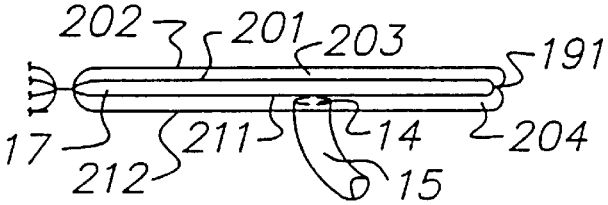
Figure 22:
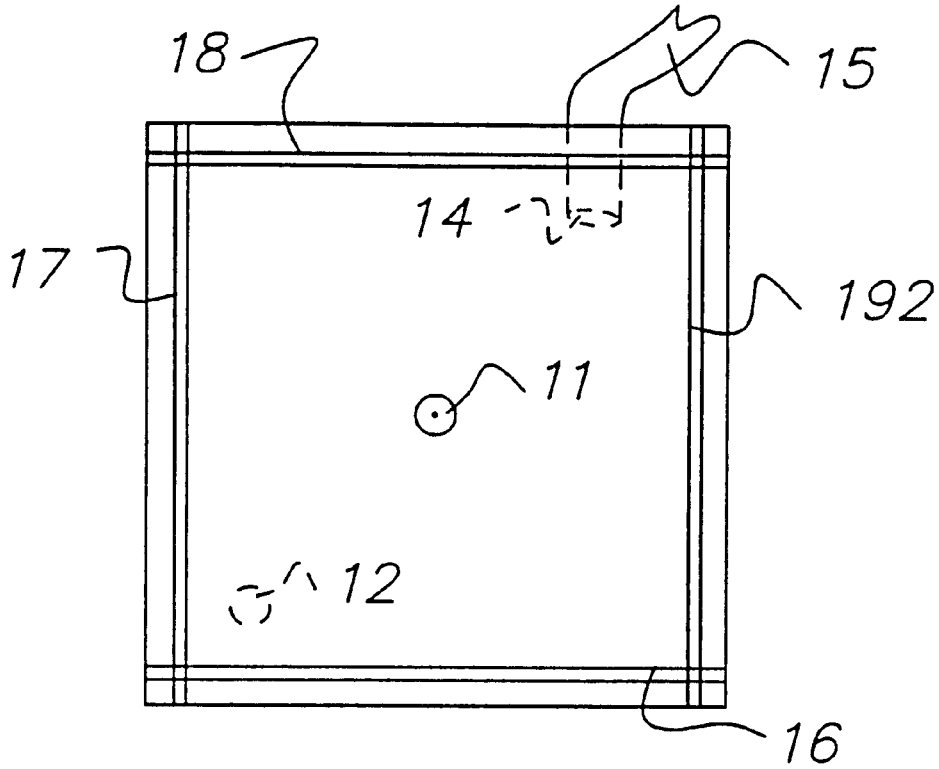
FIG. 22 is a schematic top view of the layers of FIG. 21 after the fold or cut edge has been bonded.

The bag 10 can be oriented with the equator seam horizontal, as shown in FIGS. 1A–10, or vertical, as shown in FIGS. 1B, 1C, 2B, and 2C. In the vertical orientation, the bag can be arranged with the vertical seals 16, 18 at the midpoints of the sides of the container 1 as seen in FIGS. 1B and 2B. For bags using corner drain ports, I prefer to place the vertical seals 16, 18 at the corners of the container 1, as seen in FIGS. 1C and 2C, when I orient the equator seam or partial equator seam vertically.

Where I bond the layers 20, 21 along the fold, best illustrated in FIGS. 21 and 24, I form the interlayer bond 191 before folding. The interlayer bond 191 completes the equator seam and seals the upper interply region 203 from the lower interply region 204 in the completed bag 10. In both of these variations, I still form the air input port 14 in the lower plies 25 to allow access to the lower interply region 204.

I prefer to bond the layers of material parallel to the fold and between the fold and the fill port 11 so that the interlayer bond 23 is a boundary of two interply regions 205, 206 of different dimensions, as is best seen in FIGS. 2A, 2B, 2C, 7–19 and 26–31. The larger of the interply regions is a trans-fold interply region 205 that extends away from the fill port 11 on the top of the filled bag 10, down the side of the filled bag 10, along the bottom 4 of the filled bag 10, and up the lower halves of the non-fold sides of the filled bag 10 to the partial equator seam including seams 16–18. In this case, the plies are continuous from the interlayer bond 23 to the seam 17 opposite the fold line, but I will still refer to the upper portions of the plies as "upper plies" and to the lower portions of the plies as "lower plies" for the sake of simplicity. I prefer to form my air input port 14 to allow access to the larger interply region 205, preferably in one of the seams 16, 18 between the interlayer bond 23 and the fold line 19. Alternatively, the air input port 14 can be cut through the outer ply 202 in the top of the bag 10 and include a fitting. To further enhance performance of the invention, I form diagonal seams 26, 27 from the exit side of the bag 10 to the sides extending between the exit side and the fold side. The seams join all four plies and form two pieces or flaps 28, 29 of extra material that can be trimmed away.

My invention can be applied to typical multiple-ply fitted bags, as shown in FIGS. 1D and 1E, in much the same fashion as I apply it to pillow bags. The typical fitted bag will be cut from nested gussetted tubes of bag material. Adjacent cut gusset edges will be sealed to form the top and the bottom of the bag, each with gusset lines that are visible when the bag is filled, as is known in the art. The bottom seals are made on the individual plies prior to nesting, as is also known in the art. Of course, what I refer to as the top and bottom of the bag can be sides of the bag if the user wishes to change the bag's orientation. For a fitted bag with gusset lines on the top and bottom, the plies on the top have already been sealed to form interply bond 16. I apply additional interply bonds 17, 192 down opposite corners of the bag to define the interply regions. In a fitted bag with the gussets on the sides, I form one interply bond 16' along a top edge, another interply bond 17' on one gusset lined side from a corner at the end of the first interply bond to the lower opposite corner, and I use the sealed cut gusset edges of the other gusset lined side as a third interply bond 192' to define the interply regions. These three interply bonds 16', 17', and 192' are the equivalents of the interply bonds 16, 17, and 192 of FIG. 1D. The air input port passes through one of the interply bonds 16, 16', 17, 17', 192, 192'. Additional interply bonds can be added to enhance evacuation in much the manner described above.

In use, I place one of my bags 10 in a rigid container 1, such as a plastic tote, and align its exit port 12 with a hole in the tote. In many cases, this is best accomplished by using a cassette to hold the bag 10 during insertion and filling. The cassette is configured to hold the bag as it fills so that a minimum of bag material is trapped in the container during filling, which could reduce the shipped amount of bulk material. The cassette is typically made of an inexpensive, lightweight material, such as cardboard, and is particularly useful with closed-top pillow bags. With closed-top pillow bags, I place the bag 10 on its cassette in the bottom of the container 1, attach a fill hose, and fill the bag 10 with bulk material or viscous contents 5, the bag 10 unfolding as it fills. For best evacuation results with bags using corner drain ports, I place the bag 10 in the tote so that the side of the bag 10 opposite the drain port 12 is parallel to a diagonal of the tote (a 45° rotation of the bag 10 relative to the tote). I also situate the bag 10 so that there is more bag material near the air input port side of the tote. Once the bag 10 is full, I seal the fill port 11 in whatever manner is appropriate for the particular type of bag 10 used. The filled bag 10 and plastic tote 1 are then shipped to a customer, who connects the drain port 12, if present, to a drain conduit 13 and starts using the contents 5, beginning evacuation of the bag 10. For some contents 5, the customer also attaches a pump 3 to draw the contents 5 from the bag 10. Other bulk materials 5 do not require a pump 3 and can simply be allowed to exit the bag 10 under the influence of gravity. For open-top bags without drain ports, the contents 5 can be drained using a hose connected to a pump 3 or acting as a siphon.

The air input conduit 15 can be connected to a source of pressurized air 2 at any time, though I prefer that it be connected during initial set up at the site of bag evacuation when the exit port 12 is connected to the drain conduit 13. The customer could also wait to connect the air input port 14 until the contents 5 had reached a particular level or until it became difficult to evacuate, but this requires human intervention that my invention intends to eliminate. Connecting the air input conduit 14 to the source of pressurized 2 air at any time other than initial setup is less efficient than my preferred choice of connecting the air input port 14 at initial set up since the alternatives require the customer to go back to the bag 10 to connect the air input conduit 15, check the level of the contents 5, monitor difficulty of contents evacuation, and/or wait until the pump 3 stalls.

The source of pressurized air preferably provides enough pressure for my invention to work, yet not so much as to burst the bag 10. I have found that the pressure required varies with the strength of the bag and as the inverse of the bag size. Bag strength is, of course, directly proportional to the total thickness of the plies of the bag and the strength of the bag material. The particular pressure $\rho_{desired}$ of the air provided by the source of pressurized air 2 will thus vary depending on the particular material strength $\tau$ of the bag (I prefer to use yield strength), total thickness t of the bag's plies, and the smallest diameter D of the bag when the bag is expanded and can be approximated using the formula $$p_{desired} \propto \frac{\tau t}{D}.$$

For a typical shipper bag-in-box arrangement, this formula indicates that the source of pressurized air 2 preferably should provide air at a pressure of no more than from about 1 psig to about 5 psig. I prefer to use a pressure in the range of from about 0.05 psig to about 0.5 psig (about 0.2 psig, for example), which works quite well for the typical arrangement, using an intermediate bulk container in the 300 gallon range and using a total film thickness of about twelve thousandths of an inch (mils). Whatever pressure is used, as long as it does not exceed the value given by the formula above, it will be far less than the pressure required by the prior art for the same container size and total ply thickness. A pressure regulator can be used to ensure that the appropriate pressure is maintained. The source 2 can be depressurized shop air or can be a separate source, such as a compressor or fan.

My invention begins to more noticeably enhance evacuation when the level of the contents 5 drops to a point where air 6 can enter the interply region 204, 205. Using the lower interply region 204 of the equator-seamed pillow bag 10, air 6 begins to enter the interply region 204 when the pressure exerted on the inner ply 211 by the air 6 is greater than the pressure exerted on the inner ply 211 by the contents 5 of the bag 10. Using the trans-fold interply region 205, the interply region 205 fills in a much more complex manner that depends in part on exactly how the bag 10 is positioned and filled in the tote 1, as well as the particular location of the air input port 14.

Figure 9:
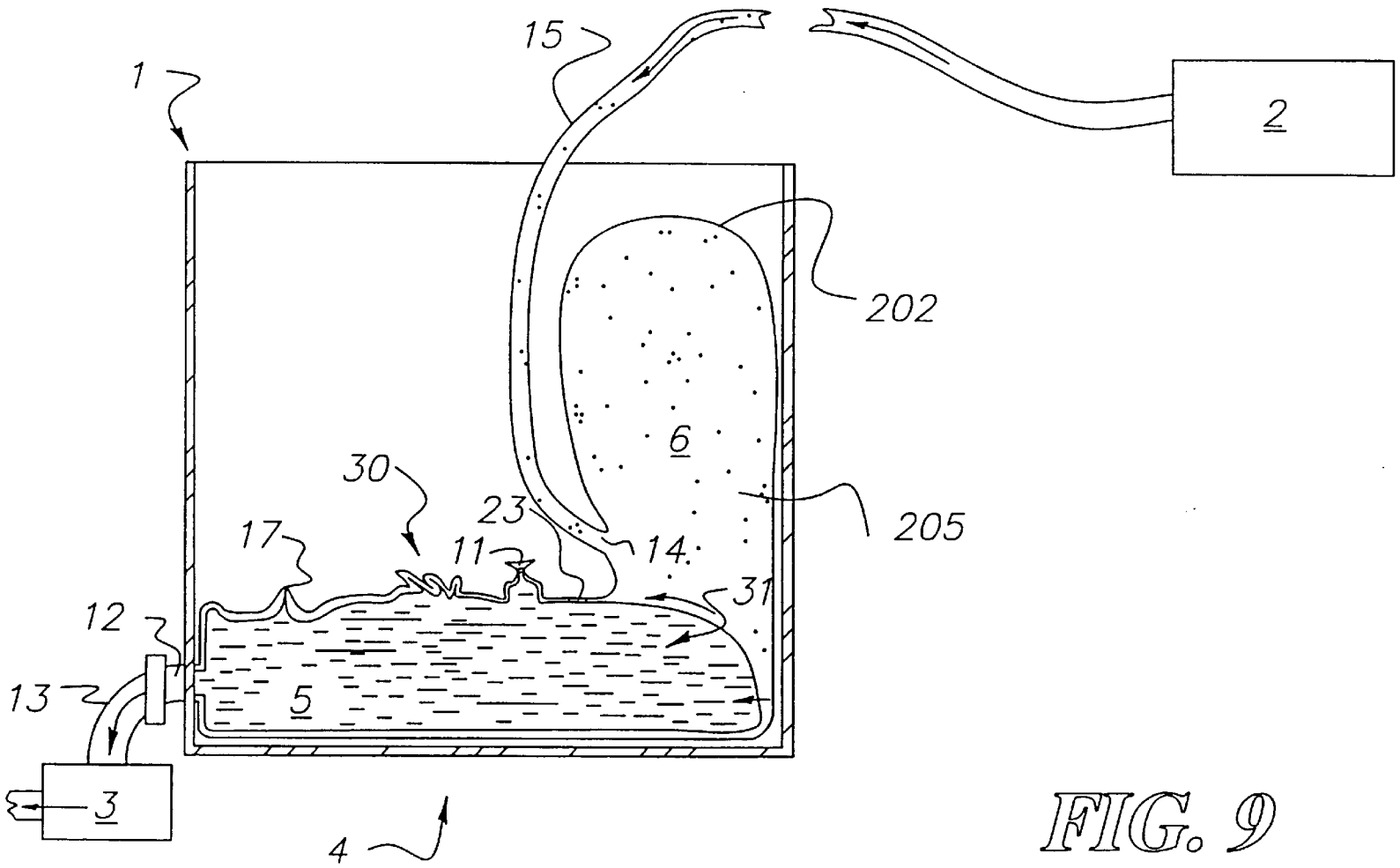
FIG. 9 is a cutaway schematic view of the bag and plastic tote of FIG. 8 after a portion of the contents of the bag have been evacuated and the interply region has inflated.
Figure 10:
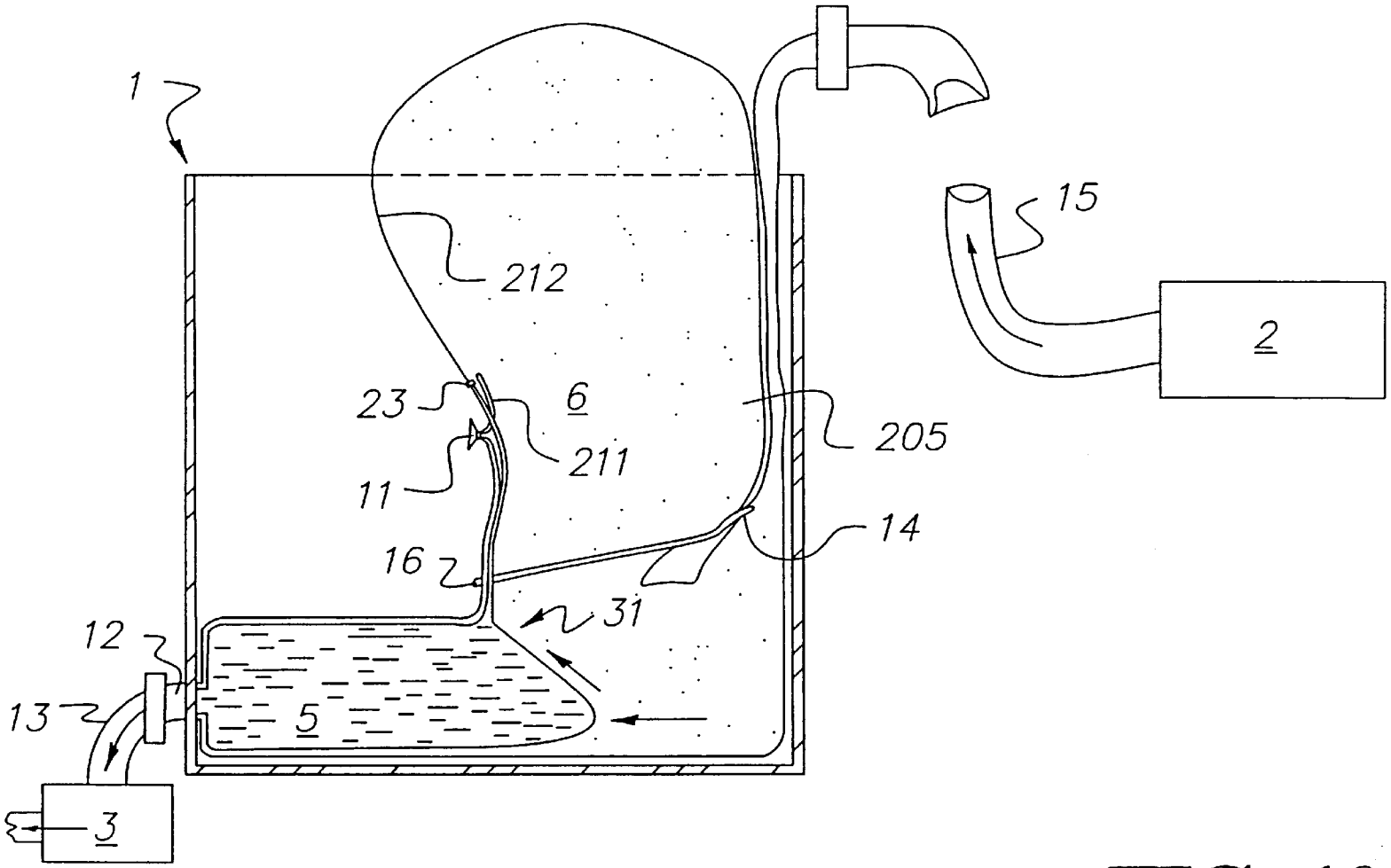
FIG. 10 is a cutaway schematic view of the bag and plastic tote of FIG. 8 after a substantial portion of the contents of the bag have been evacuated and the interply region has inflated.
Figure 11:
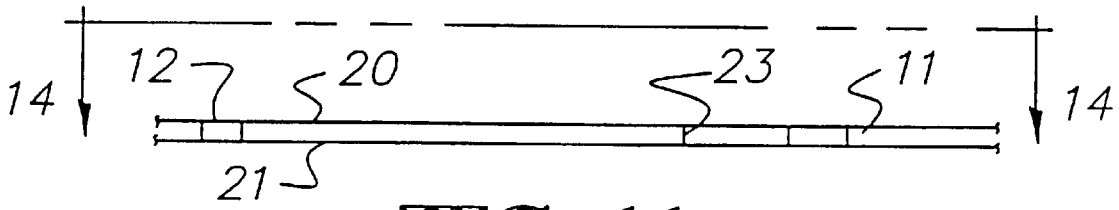
FIG. 11 is a schematic side view of two layers of material used to make the invention according to an aspect of the invention yielding the bag shown in FIG. 2A.
Figure 14:
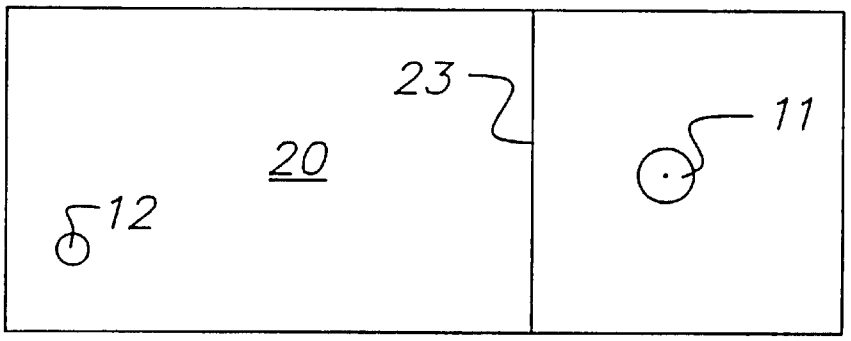
FIGS. 14–16 are schematic top views of the layers of material shown in FIGS. 11–13.
Figure 17:
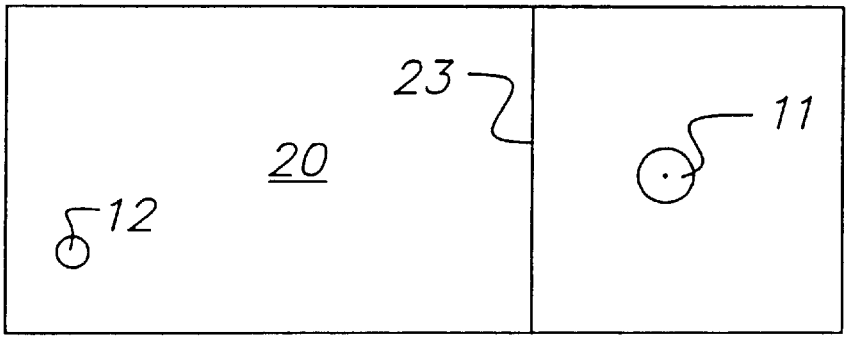
FIGS. 17 and 18 are schematic top views of the layers of material shown in FIGS. 11 and 12 as used in a variation of the invention resulting in the bag shown in FIG. 19.
Figure 12:
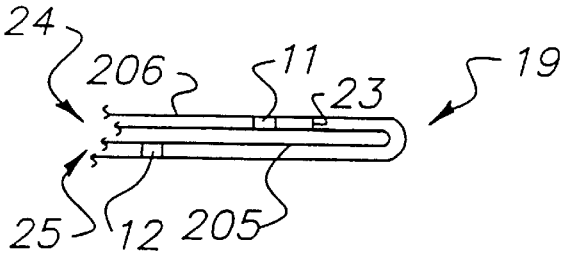
FIG. 12 is a schematic side view of the two layers of material shown in FIG. 11 after they have been folded.
Figure 13:
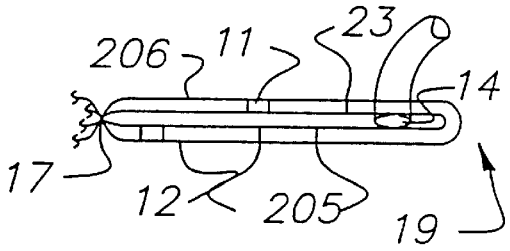
FIG. 13 is a schematic side view of the two layers of material shown in FIG. 12 after the non-fold edges have been bonded.
Figure 15:
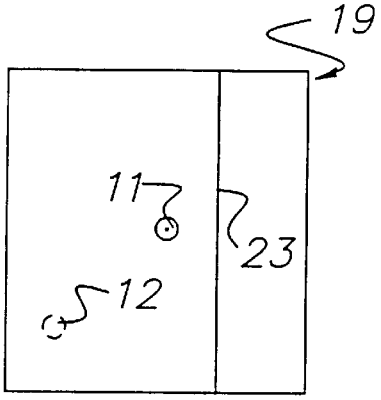
Figure 16:
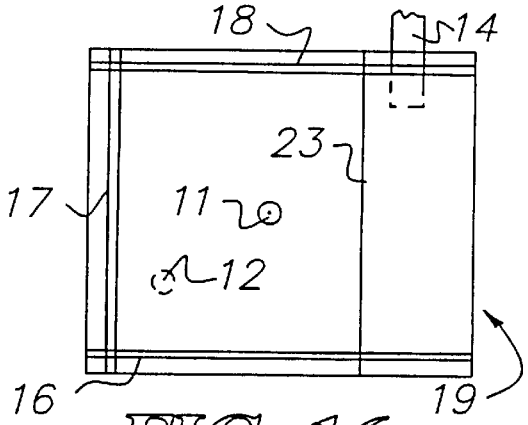
Figure 18:
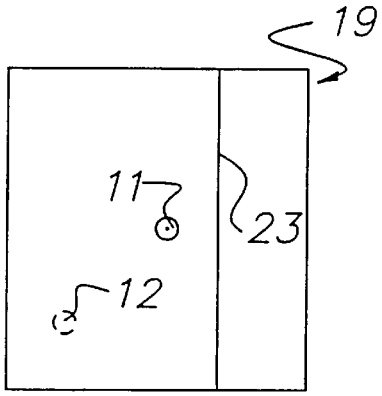
Figure 19:
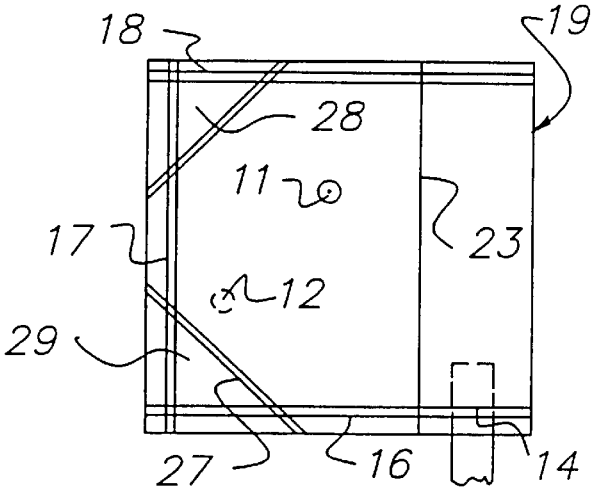
FIG. 19 is a schematic top view of the layers of material shown in FIG. 13 according to the variation of the invention of FIGS. 17 and 18.

With particular reference to FIGS. 8–10 and 26–31, for the preferred connection of the air input port 14 to the interply region 205, the interply region 205 fills as the contents 5 of the bag 10 are evacuated. Initially, the top part of the outer ply 202, 212 balloons or plumps up and the top part of the inner ply 201, 211 urges the contents 5 to move away from the side wall as seen in FIG. 9, much like a wedge. As the bag contents level continues to drop, it is urged farther and farther from the side wall. Eventually the bag contents level drops enough and the interply region plumps enough that the bottom part of the inner ply 201, 211 is pulled up and toward the drain port 12 as seen in FIGS. 9, 10, and 28–31.

The plumping of the interply regions 204, 205 of both variations has numerous effects. First, the bottom 4 of the bag 10 above the interply region 204, 205 effectively gradually becomes a moving wall portion 31 of the bag 10 that urges the contents 5 toward the drain port 12 in the direction indicated by the arrows in FIGS. 6, 9, 10, and 27–31. In the process of becoming the moving wall portion 31, the bottom 4 of the bag 10 inclines, allowing gravity to act on the contents 5 for a reduction in the amount or material retained in the bag 10 when no more material can be removed.

Because the volume of the bag 10 interior is effectively reduced by the moving wall portion 31, the level of the bag contents 5 in the remaining interior is kept above the top of the drain port 12 until nearly all of the contents 5 have been evacuated. In ordinary shipper bags, evacuation of the contents without allowing air into the interior of the bag causes the bag to collapse, yielding piles and folds of material floating on the free surface of the contents. The drain port of the ordinary shipper bag can become blocked by the folds and piles of bag material when the contents level drops below the top of the drain port. Drain port blockage can cause pump stalling and trap a significant amount of bag contents within the bag. However, the inflation of the interply region 205 of my shipper bag significantly delays or eliminates this blockage by keeping the level of the contents 5 above the drain port 12 longer. As the interply region 204, 205 inflates, it also pulls any folds 30 of the inner ply 201, 211 taut to reduce the number of folds 30. The elimination of folds 30 of the inner ply 201, 211 further reduces the risk of stalling the pump 3 since it prevents or at least significantly delays the folds 30 from being sucked against the drain port 12. This eliminates the need for antivacuum devices and leaving the plunging arrow extended to prevent suction of the folds 30 against the drain port 12. Alternatively, my invention enhances the effectiveness of antivacuum devices and extension of the plunging arrow if they are still employed. As an added benefit particularly shown in FIG. 10, the plumped bag 10 extends considerably above the top of the tote when the bag 10 is nearly empty so that it acts as a bag-empty indicator.

To summarize the preferred operation of the invention with particular reference to FIGS. 26–31, prior to discharge of the bag contents, I connect the air chamber to a source 2 of low pressure air just sufficient to lift the contents 5 (less than one psig for a four-foot container). During discharge of the contents 5, the inner ply 211 of the air chamber, mostly interply region 205, moves the contents 5 to the drain port 12 so that the bag 10 is completely or nearly completely evacuated without human attendance. The air 6 expands the air chamber until a force balance is reached with the weight of the bulk material 5 (this can also be expressed as a pressure balance between air pressure and bulk material pressure on the inner ply). Since the air chamber extends down the wall of the container and under the bulk material 5, it pushes the bulk material 5 away from the wall as it inflates. As the volume of the bag contents 5 diminishes, the air chamber continues to expand by inflation.

The air chamber and the bag 10 are configured so that the air chamber expands to the greatest extent in a region of the container away from the drain 12, thus forcing the contents 5 toward the drain 12. As the chamber expands, the increased area on which the air pressure acts increases the force exerted on the bulk material 5 by the inner ply(ies) 201, 211 of the bag. The force reaches a maximum when the bag is nearly completely evacuated, at which point the bag material would normally obstruct the drain 12. However, the bulk material 5 at the drain 12 floats adjacent bag material above the drain 12, preventing the bag material from blocking the drain 12 and trapping bulk material 5 in the bag. Additionally, the inflation of the air chamber pulls the bag material taut so that the drain 12 remains unobstructed.

The fitting of the drain 12 is locked in the container and seals through the bag plies 201, 202, 211, 212. This anchors or ties the bag 10 down at one point in, at, or near the floor of the container 1. This also limits the inflation of the air chamber at and around the drain port 12. The air chamber is also configured so that its expansion pulls the layers 201, 202, 211, 212 of the bag taut. When the volume of bulk material 5 left in the bag 10 is insufficient to float the bag material above the drain 12, this tension helps to prevent the bag material from closing off the drain 12. The air chamber is optimally configured so that, near the end of evacuation, all the remaining bulk material 5 is lifted off the floor of the container 1, above the level of the drain 12. This allows the bulk material 5 to flow down into the drain 12 as if it were in a funnel. The bulk material 5 can be used as a fourth quasi-seal, as seen in FIGS. 26–31. If the bulk material 5 is used as a fourth quasi-seal, then air seeps under the bulk material 5 and expands into air chambers, including interply region 206, on both sides of the bulk material 5 formed in the main air chamber by the presence of the bulk material 5. This action pulls the bag layer in front of the drain up at an angle, providing a gap for flow of the remaining bulk material 5 to the drain port.

I can also include an integral filling conduit 110 in my exemplary embodiment of an evacuation enhanced pillow bag 10', as particularly shown in FIGS. 32–36. I also refer to the integral filling conduit as a snout. With respect to this aspect of the invention, I make reference to my U.S. patent application Ser. No. 09/238,338, filed concurrently herewith, the disclosure of which is hereby incorporated by reference. This form of my invention is very similar in its construction and use to that shown in FIGS. 2A, 2B, 2C, 7–19 and 26–31. To make my bag with a snout, I prefer to start with two pieces of material 100', 100" very much as described above and stacked so that, when folded in half, one half of each piece of material 100', 100" forms a back layer or ply 101', 101", and the other half of each piece of material 100', 100" forms a front layer or ply 102', 102". Alternatively, the back and front layers can each be their own separate pieces of material rather than halves of larger pieces of material. Preferably, the layers of material 100', 100" are rectangular. I then take the two back layers 101', 101" and bond them together to form a rear interlayer or interply bond 23', which is similar in location and function to the top interlayer bond 23 mentioned above. I also form the rear snout interlayer bond 111'. I insert an air input conduit 15' between the back layers 101', 101" to allow access to a back interply region 120 between the back layers 101', 101" as seen particularly in FIG. 35. The back interply region 120 is similar in form and function to the smaller interply region 206 described above.

Next I take the two front layers 102', 102" and bond them together to form a front interlayer or interply bond 108, as well as the front snout interlayer bond 111". I then bond all four layers 101', 101", 102', 102" together to form the sides and base of the rectangle and the sides of the trapezoid with seams or seals 16', 18', 26', 27'. Depending on the particular application of the bag, I can also seal along the fold line 19'. If this is done before the pieces of material 100', 100" are folded, then an interply bond 191' is formed between the pieces of material 100', 100". If this is done after the pieces of material 100', 100" are folded, or if this is done where each layer 101', 102', 101", 102" is its own piece of material, then an interply bond 192' is formed between all four layers 101', 102', 101", 102". I form the drain port 12' in the front layers 102', 102".

The seams 16', 18', 26', 27', the rear interlayer bond 23', and front interlayer bond 108 define the back interply region 120 and a front interply region 130. While I prefer to include the front interlayer bond 108 to improve performance of the enhanced snout bag 10', it can be left out, in which case the fold 19'is used to delineate the two interply regions 120, 130 in much the same way as the variation of my enhanced pillow bag of FIGS. 2A, 2B, 2C, 7–19 and 26–31, and the bulk material 5 acts to seal the regions from each other.

The rear and front interply bonds 23', 108, along with the side seams 16', 18', 26', and 27', define an inflatable air chamber in the back and rear interply regions 120, 130. The air chamber extends from the back interply bond 107 down the side of the bag 10', under the contents of the filled bag 100', and up the opposite side of the bag 10' to the front interply bond 108. When a user is ready to discharge the contents of the filled bag 10', he or she connects the air input conduit 15' to a source of pressurized air. As the contents of the bag 10' are discharged, the air chamber inflates, expanding the interply regions 120, 130. The inflation of the air chamber pulls up on the inner ply 101", 102" along the side and bottom of the bag 100'.

Here, as shown particularly in FIG. 9, I prefer to arrange the bag 10' with the edge seams 16', 18', 26', and 27' in the corners of the rigid container 1' and the drain port 12' protruding from a hole in the rigid container 1'. Once the bag 10' is filled, the air input conduit 15' runs up between the side of the bag 10' and the side of the container 1' and over the edge of the container 1'.

Prior to discharge of the bag contents, I connect the air chamber to a source of low pressure air just sufficient to lift the contents (preferably less than one psig for a four-foot container). During discharge of the contents, the inner ply 101', 102' of the air chamber moves the contents to the drain 12' so that the bag 10' is completely or nearly completely evacuated without human attendance. The air expands the air chamber until a force balance is reached with the weight of the fluid (this can also be expressed as a pressure balance between air pressure and fluid pressure on the inner ply). Since the air chamber extends down the wall of the container and under the fluid, it pushes the fluid away from the wall as it inflates. As the volume of the bag contents diminishes, the air chamber continues to expand by inflation.

The air chamber and the bag are preferably configured so that the air chamber expands to the greatest extent in a region of the container away from the drain, thus forcing the contents toward the drain. As the chamber expands, the increased area on which the air pressure acts increases the force exerted on the fluid by the inner ply(ies) of the bag. The force reaches a maximum when the bag is nearly completely evacuated, at which point the bag material would normally obstruct the drain. However, the fluid at the drain floats adjacent bag material above the drain, preventing the bag material from blocking the drain and trapping fluid in the bag. Additionally, the inflation of the air chamber pulls the bag material taut so that the drain remains unobstructed.

The drain fitting is locked in the container and seals through the bag plies. This anchors or ties the bag down at one point in, at, or near the floor of the container. This also limits the inflation of the air chamber at and around the drain port. The air chamber is also configured so that its expansion pulls the layers of the bag taut. When the volume of fluid left in the bag is insufficient to float the bag material above the drain, this tension prevents the bag material from closing off the drain. The air chamber is optimally configured so that, near the end of evacuation, all the remaining fluid is lifted off the floor of the container, above the level of the drain. This allows the fluid to flow down into the drain as if it were in a funnel. The fluid can be used as a fourth quasi-seal. If the fluid is used as a fourth quasi-seal, then air seeps under the fluid and expands into chambers on both sides of the fluid formed in the main air chamber by the presence of the fluid. This action enhances the evacuation by pulling the bag layer in from the of drain up at an angle. This angle provides a gap for flow of the remaining fluid to the drain port.

PARTS LIST

1 Rigid/Plastic container/tote
2 Source of pressurized air
3 Pump
4 Bottom region of bag and container/tote
5 Contents of bag; bulk material contents; bulk material; viscous or semi-flowable contents
6 Air in interply region
10 Multiple-ply bag
10' Snout bag; pillow bag with integral fill conduit
11 Fill port
12, 12' Drain port; exit port; drain
13 Drain/Exit conduit
14, 14' Air input port
15, 15' Air input conduit
16-18 Interply bonds
16' Second main seam of snout bag
18' First main seam of snout bag
19, 19' Fold
20 Upper/Top layer
21 Lower/Bottom layer
23 Top interlayer bond
23' First/back interlayer bond of snout bag; first/back interply bond of snout bag
24 Upper plies
25 Lower plies
26 Diagonal seam
26' First diagonal seam of snout bag
27 Diagonal seam
27' Second diagonal seam of snout bag
28, 28' Flap; extra piece of material
29 Flap; extra piece of material
30 Folds of material resulting from bag collapse/evacuation
31 Moving wall portion of inner ply(ies)
100', 100" Pieces of material of snout bag
101', 101" Back layers of material of snout bag; back plies of snout bag
102', 102" Front layers of material of snout bag; front plies of snout bag
108 Second/front interlayer bond of snout bag
191, 191' Interlayer bond along fold
192, 192' Interply bond along fold
201 Upper/Top inner ply; top part of inner ply
202 Upper/Top outer ply; top part of outer ply
203 Upper/Top interply region
204 Lower interply region
205 Larger interply region; trans-fold interply region
206 Smaller interply region
211 Lower inner ply; bottom part of inner ply
212 Lower outer ply; bottom part of outer ply

I claim:

1. A method of enhancing evacuation of a multiple-ply bag of the pillow bag type, the pillow bag including a seam at least partially about a circumference of the bag and including at least two upper plies and at least two lower plies, the plies being of substantially identical dimension and being sealed together at respective edges by the seam, regions between the upper plies being sealed off from respective regions between the lower plies, the pillow bag containing a bulk material and including an exit port through which the bulk material can flow from the bag, the method including the steps of:

connecting a region between two plies of the multiple-ply bag to a source of pressurized air;

emptying the viscous contents of the bag through the exit port; and allowing pressurized air from the source of pressurized air to inflate the region between the two plies when enough of the contents of the bag has been emptied that a pressure exerted on an inner of the two plies by the pressurized air is greater than a pressure exerted on the inner of the two plies by the contents, the inner of the two plies thereby urging the contents toward the exit port of the bag.

2. The method of claim 1 wherein the method further includes placing the bag in a rigid container before pumping so that an exit port of the bag is aligned with a hole in the rigid container.

3. The method of claim 2 wherein the step of providing includes using a bag that is substantially larger than the rigid container so that excess bag material is present when the bag is filled and is in the rigid container.

4. The method of claim 3 wherein the step of providing further includes arranging the bag so that more excess bag material is disposed away from the bag exit port.

5. The method of claim 2 wherein the bag plumps as the region between the two lower plies fills with air until a portion of the bag is visible above the rigid container and the method further includes using the visible portion of the bag as an indicator that the bag is substantially empty.

6. The method of claim 1 wherein the step of pumping includes connecting the bag to a source of pressurized air, the pressurized air having a desired pressure the value of which depends on a yield strength of a material used to make the plies, a total thickness of the plies, and a smallest diameter of the bag when the bag is expanded.

7. The method of claim 1 wherein the step of providing includes forming an air input conduit and the step of pumping includes:

connecting a first end of the air input conduit to a lower region of the bag so that air traveling through the conduit can enter a region between the two lower plies; and connecting a second end of the air input conduit to a source of pressurized air.

8. The method of claim 1 wherein the step of allowing is performed when the contents have reached a predetermined level.

9. The method of claim 1 wherein the bag is arranged in the rigid container such that folds of excess material from collapse of the emptying bag are pulled taut as the region plumps, thereby at least significantly delaying blockage of the exit port by bag material.

10. An arrangement enhancing output of viscous contents of a bag including:

an air input port formed on a multiple-ply bag, the multiple-ply bag including a plurality of plies of substantially identical perimetral extent, at least one edge of each ply being joined to at least one respective edge of another ply, the air input port being connectable to a source of pressurized air;

an interply region between two plies of the plurality of plies of the bag with which the air input port is in fluid communication so that the interply region can fill with pressurized air from a source of pressurized air when a source of pressurized air is connected to the air input port;

a drain extending from an interior of the bag to an exterior of the bag allowing contents of the bag to be emptied when present;

a portion of the bag acting as a bottom of the bag; and an inner of the two plies having a bottom part at least partially overlying the bottom of the bag and being arranged so that an increasing portion of the bottom part of the inner ply can become a wall part of the inner ply substantially non-parallel to a the bottom of the bag to increase a depth of the bulk material remaining in the bag.

11. The arrangement of claim 10 wherein the air input port is attached to a first end of an air input conduit and a second end of the air input conduit can be connected to the source of pressurized air.

12. The arrangement of claim 10 wherein the plies include upper plies and lower plies, the upper plies and the lower plies being joined at respective edges to form a seam along at least a portion of a circumference of the bag, the bag thus formed being a pillow bag.

13. The arrangement of claim 10 wherein the source of pressurized air provides air at a pressure less than a desired pressure determined according to the formula $$p_{desired} \propto \frac{\tau t}{D},$$

where $\tau$ is a yield strength of a material used to make the plies of the bag, t is a total thickness of the plies, and D is a smallest diameter of the bag when it is expanded.

14. The arrangement of claim 10 wherein the bag is formed so that the bonded edges of the plies lie in a vertical plane when the bag is in use, opposite side edges of the plies being bonded from top edges to bottom edges, and the bag further includes:

a diagonal seam extending from a point along each side edge to a respective point along the top edge;

an unbonded portion of the top edge between the points at which the diagonal seams meet the top edge;

the diagonal seams defining edges of an integral filling conduit of the bag and the unbonded portion of the top edge being a mouth of the integral filling conduit.

15. The arrangement of claim 10 wherein the bag is a fitted bag cut from a length of a gussetted web of multiple-ply bag material and sealed on its ends, the sealed ends partly defining the interply regions.

16. A method of using the bag of claim 10 including the steps of:

connecting a first end of an air input conduit to the air input port of the bag after the bag has been filled with bulk material;

connecting a second end of the air input port to the source of pressurized air so that pressurized air can travel through the air input conduit to the interply region; and allowing pressurized air to enter into fluid communication with the interply region via the air input conduit and the air input port so that a bottom portion of the inner ply can urge the bulk material toward an exit port of the bag.

17. The method of claim 16 wherein the bag is arranged in a rigid container and the exit port of the bag is substantially peripherally disposed in a bottom of the rigid container and the predetermined level is a level at which the bottom portion of the inner ply can assume a slope toward the exit port.

18. The method of claim 16 wherein the bag is disposed in a rigid container and the exit port of the bag is disposed in a wall of a rigid container adjacent a bottom of the rigid container and the predetermined level is a level at which the bottom portion of the inner ply can assume slope toward the exit port.

19. The method of claim 16 wherein the step of connecting the second end is performed during a setup of the bag in the rigid container.

20. The method of claim 16 wherein the step of connecting the second end is performed when the bulk material reaches a level at which pressurized air can inflate the interply region and cause the inner ply to urge the bulk material toward the exit port.

21. The method of claim 16 wherein the step of allowing is performed when a pressure exerted on the inner ply by the pressurized air is greater than a pressure exerted on the inner ply by the bulk material.

22. A method of enhancing evacuation of a multiple-ply, bulk material-filled bag including a plurality of plies substantially identical to each other in dimension, at least one edge of each ply being joined to a respective edge of at least one other ply, the method including the steps of:

connecting a region between two plies of the bag to a source of pressurized air, one of the two plies being an inner ply and another of the two plies being an outer ply; and inflating the region between the two plies with pressurized air from the source of pressurized air, the region extending under the bulk material, the pressurized air causing the inner ply of the two plies to urge the bulk material toward an exit port of the bag.

23. The method of claim 22 wherein the step of inflating occurs automatically when a pressure exerted on the inner ply by the pressurized air is greater than a pressure exerted on the inner ply by the bulk material.

24. The method of claim 22 wherein the bag is a pillow bag comprising at least two top plies and at least two bottom plies, the top and bottom plies being joined at edges of the plies, and the region is between two of the bottom plies.

25. The method of claim 22 wherein the step of connecting includes connecting an air input conduit to a source of pressurized air, the conduit being attached to the bag so that the pressurized air can penetrate to the region between the two plies.

26. The method of claim 22 wherein the bag is a pillow bag with an equator at which edges of at least two upper plies of the pillow bag are joined to respective edges of at least two lower plies and the region is between two of the at least two lower plies.

27. The method of claim 22 wherein the step of inflating induces a slope in the inner ply so that a portion of the inner ply near the exit port is lower than a portion of the inner ply distant from the exit port.

28. A method of using the arrangement of claim 10 including the steps of:

filling the bag with viscous contents;

connecting the air input port to a source of pressurized air; and opening the drain to allow the viscous contents to exit the bag, a portion of the inner of the two plies farthest from the drain port and highest relative to the bottom of the bag plumping in response to pressurized air from the source of pressurized air, the plumping portion of the inner ply thereby pulling the bottom part of the inner ply and causing it to increase its slope so that the increasing portion of the bottom part of the inner ply becomes the wall part.

29. A method of enhancing drainage of viscous contents of a multiple-ply bag, the bag including at least two plies all of substantially identical dimension, the method including the steps of:

pulling an inner ply of two plies of the bag;

changing part of the inner ply from being part of the bottom of the bag to being a movable wall a portion of which is substantially perpendicular to the bottom of the bag;

moving the movable wall toward a drainage port of the bag; and urging viscous contents of the bag toward the drainage port.

30. The method of claim 29 further including providing an interply region defined by the two plies of the bag and connecting the interply region to a source of pressurized air before pulling, changing, moving, and urging.

31. The method of claim 30 further including inflating the interply chamber by exposing the interply region to pressurized air from the source of pressurized air and opening an exit port of the bag so that, when a pressure balance on the inner ply created by the contents and the pressurized air allows, air enters the interply region.

32. The method of claim 31 wherein tension in the plies defining the interply region increases as the interply region fills with air, an upper portion of the interply region filling first and pulling up on the inner ply, thereby achieving the steps of pulling, changing, moving, and urging.

33. A method of making the arrangement of claim 10 including the steps of:

providing at least two layers of material;

cutting the layers of material to a first size and to a shape having at least four sides;

folding the layers of material in half to form a fold delineating the layers into at least four plies with at least four sides each, the plies including at least two upper plies and at least two lower plies, the region being located between two of the lower plies;

bonding the plies to one another along respective sides;

forming a fill port through the upper plies so that viscous contents can be introduced into an interior of the bag; and forming the air input port so that air can be introduced into the interply region, the interply region lying between the at least one inner ply and the at least one remaining lower ply.

34. The method of claim 33 wherein the step of bonding includes bonding respective non-fold sides of the plies to each other and the method of making further includes bonding at least the upper plies to one another to form a seam substantially parallel to the fold, the seam and the bonded non-fold sides thereby sealing the interply region.

35. The method of claim 34 wherein the seam includes upper and lower plies and lies substantially along the fold.

36. The method of claim 33 wherein the step of forming the air input port includes forming the air input port through all but at least one inner ply of the lower plies.

37. The method of claim 33 wherein the step of forming the air input port includes inserting the air input port between two plies of the bag at a location that will become seam so that the air input port is in fluid communication with the interply region and with an exterior of the bag.

38. The method of claim 37 wherein the air input port is a multiple-ply tube with interply bonds at ends of the air input port.

39. A system for evacuating semi-flowable bulk material from a multi-ply pillow bag arranged within a shipping container, the system comprising:

a. an air input passageway extending to an interply region of the pillow bag that extends under liquid contained within bottom plies of the bag supported on a bottom of the container;

b. the interply region of the bag being configured to contain pressurized air accumulating initially in a region opposite a drain from the bag and to exclude the pressurized air from substantial upper regions of the bag; and c. the bag being configured and located within the container so that pressurized air within the interply region counteracts liquid pressure within the bag to raise a ply of the bag against the bulk material in a region remote from the drain, thereby urging bulk material toward the drain and increasing bulk material depth so that folds of material collecting from bag collapse ride on the surface of the bulk material, the surface of the bulk material being maintained at a level above the drain by the raised ply of the bag in the interply region, thereby preventing blockage of the drain port by the folds of material.

40. The system of claim 39 further including an integral filling conduit of the bag defined by;

side seams of the bag including side edges of the plies bonded to each other;

diagonal seams extending from the side seams to top edges of the plies and defining side edges of the integral filling conduit, the top edges including top edges of back plies and top edges of front plies;

portions of the back ply top edges that are bonded to each other;

portions of the front ply top edges that are bonded to each other; and a mouth of the integral filling conduit providing access to an interior of the bag between the bonded portions of the back and front ply top edges, the mouth extending between points at which the diagonal seams meet the top edges.

41. The system of claim 39 wherein the interply region extends above a top of the container when the bag is nearly empty, thereby acting as a bag empty indicator.

42. A combination of a shipping container and a multi-ply pillow bag arranged within the container for holding a semi-fluid material within the multi-plies of the pillow bag for shipment with the container, the combination comprising:

a. an air inlet arranged in communication with an interply region of the pillow bag extending below an equator of the pillow bag and underneath the material contained within the pillow bag;

b. seams of the pillow bag being configured to contain within the interply region low pressure air pumped into the interply region and to substantially exclude the low pressure air from a top region of the bag; and c. the interply region being arranged to be balloonable in a region opposite a drain from the bag so that air pressure ballooning the interply region of the bag counteracts material pressure applied in a bottom region of the bag to displace the material toward the drain.

43. The combination of claim 42 wherein the pillow bag is arranged within the container so that the interply region has more ballooning capability remote from the drain than adjacent the drain.

44. The combination of claim 42 wherein the container has an open top when the material is being evacuated, and the ballooning bag extends above the container top to provide a visual indication that the bag is nearly empty.

45. The combination of claim 42 wherein the ballooning of the bag commences when a material level within the bag is low enough so that low pressure air within the interply region can displace the material toward the drain.

46. In a bulk material shipping container lined with a pillow bag having a drain for withdrawing semi-fluid contents from the bag, a method of keeping the drain flooded with contents being withdrawn, for more completely emptying the bag, the method comprising:

a. applying low pressure air to an interply region of the bag extending below an equator seam of the bag and below the contents within the bag; and b. prearranging the bag within the container to provide ballooning room opposite the drain for the interply region so that as a contents level within the bag lowers, air pressure balloons the interply region of the bag opposite the drain and displaces the contents toward the drain and keeps the drain flooded with the contents until the bag is nearly empty.

47. The method of claim 46 further including regulating the low pressure air to a desired pressure the value of which depends of a yield strength of a material used to make the plies, a total thickness of the plies, and a smallest diameter of the bag when the bag is expanded.

48. The method of claim 46 further including using the bulk material displaced by the interply region to keep pillow bag material from clogging the drain during withdrawal of the bulk material.

49. The method of claim 46 wherein the interply region is seamed to exclude the interply region substantially from upper regions of the bag above an equator of the bag.

50. The method of claim 22 wherein:

the plies have top, bottom, and side edges;

all plies are bonded along each side edge from top to bottom;

all plies are bonded along non-intersecting diagonal seams extending from a point along respective side edges to respective points along the top edge, the diagonal seams defining edges of an integral filling conduit of the bag; and a mouth of the integral filling conduit along a portion of the top edge extending between the points at which the diagonal seams meet the top edge, the mouth including back layers of material bonded to each other and front layers of material bonded to each other.

51. The method of claim 34 wherein the bag orientation is changed so that the upper plies are back plies and the lower plies are front plies, and the step of forming the fill port includes the steps of:

bonding the plies to each other along diagonal seams each terminating at one end in a respective one of two opposite bonded non-fold sides at a point between the seam substantially parallel to the fold and a non-fold side opposite the fold, the diagonal seams each terminating at another end along the non-fold side opposite the fold, the diagonal seams thereby defining edges of an integral fill conduit of the bag;

removing flaps of material extending from the diagonal seams to respective corners of the plies;

bonding the back plies to each other along at least a portion of the non-fold side opposite the fold; and bonding the front plies to each other along at least a portion of the non-fold side opposite the fold;

the bonded back plies and bonded front plies defining a mouth of the integral fill conduit providing access to an interior of the bag, the mouth thereby being the fill port of the bag.

52. The combination of claim 42 wherein the seams of the bag include side seams along opposite edges of the bag and diagonal seams extending from the side seams to a top of the bag to define an integral conduit of the bag, a mouth of the integral conduit extending between points at which the diagonal seams intersect the top of the bag.

* * * * *

US006234351C1

(12) EX PARTE REEXAMINATION CERTIFICATE (9681st)

United States Patent
Wilcox

(10) Number: US 6,234,351 C1
(45) Certificate Issued: May 29, 2013

(54) APPARATUS AND METHOD FOR ENHANCING EVACUATION OF BULK MATERIAL SHIPPER BAGS

(75) Inventor: Donald E. Wilcox, Rochester, NY (US)

(73) Assignee: A. R. Arena Products, Inc., Rochester, NY (US)

Reexamination Request:
No. 90/012,238, Apr. 17, 2012

Reexamination Certificate for:

| | |
|---|---|
| Patent No.: | **6,234,351** |
| Issued: | **May 22, 2001** |
| Appl. No.: | **09/237,819** |
| Filed: | **Jan. 27, 1999** |

Related U.S. Application Data

(60) Provisional application No. 60/072,815, filed on Jan. 28, 1998, provisional application No. 60/072,816, filed on Jan. 28, 1998.

(51) Int. Cl.
*B65D 35/28* (2006.01)

(52) U.S. Cl.
USPC ..... 222/95; 222/386.5; 222/389; 383/3; 383/41; 383/109

(58) Field of Classification Search
None
See application file for complete search history.

(56) References Cited

To view the complete listing of prior art documents cited during the proceeding for Reexamination Control Number 90/012,238, please refer to the USPTO's public Patent Application Information Retrieval (PAIR) system under the Display References tab.

*Primary Examiner* — Joseph A. Kaufman

(57) ABSTRACT

A pillow bag is modified to include an air input port that allows inflation of an interply region of the bag. As the interply region inflates, an inner ply rises and becomes an advancing wall, raising the bulk material level in the bag, inclining the bottom of the bag, and pulling excess material away from the drain port all at the same time. In another embodiment, the pillow bag is made with half the initial number of layers folded in half to create the upper and lower plies and the non-fold edges are bonded. Where corner drain ports are used, the bag can he arranged so that an interlayer bond parallel to the fold is parallel to a diagonal of a tote in which the bag sits and so that the interlayer bond is opposite the drain port to enhance bag evacuation. An additional optional feature of the invention is the inclusion of an integral filling conduit or snout on the top of the bag, a mouth of which acts as a fill port to ease filling of the bag. The invention can also be applied to fitted bags.

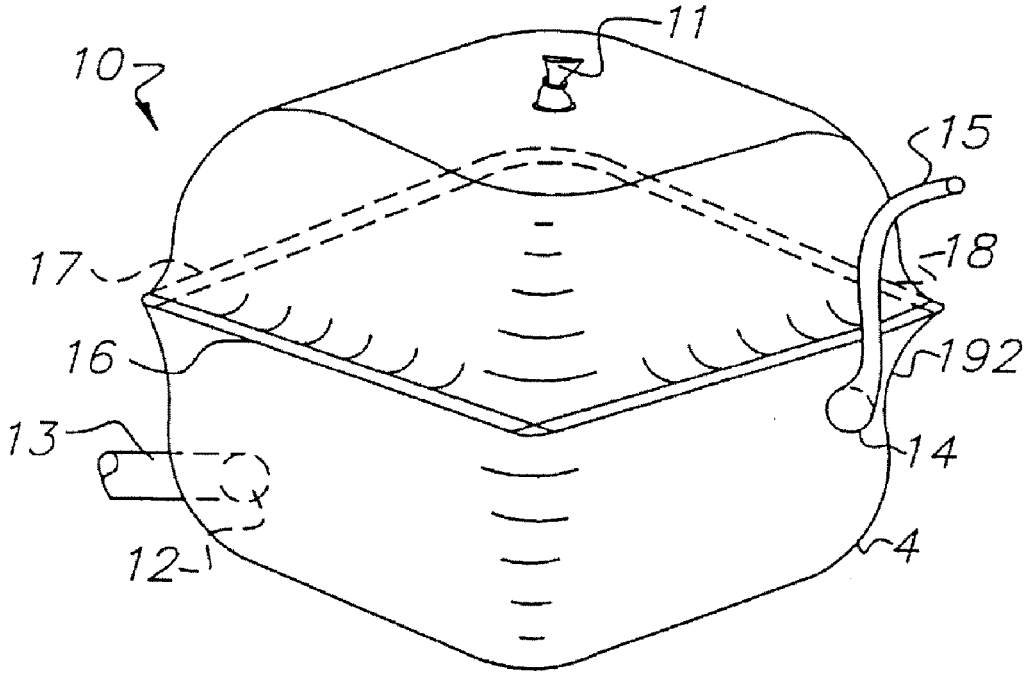

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9-13, 15-21, 27, 28, 33-35, 37 and 38 is confirmed.

Claims 1, 22 and 29-32 are cancelled.

Claims 2, 6-8, 23-26, 46 and 50 are determined to be patentable as amended.

Claims 3-5 and 47-49, dependent on an amended claim, are determined to be patentable.

New claims 53-59 are added and determined to be patentable.

Claims 14, 36, 39-45, 51 and 52 were not reexamined.

2. The method of claim [1] *9* wherein the method further includes placing the bag in a rigid container before pumping so that an exit port of the bag is aligned with a hole in the rigid container.

6. The method of claim [1] *9* wherein the step of pumping includes connecting the bag to a source of pressurized air, the pressurized air having a desired pressure the value of which depends on a yield strength of a material used to make the plies, a total thickness of the plies, and a smallest diameter of the bag when the bag is expanded.

7. The method of claim [1] *9* wherein the step of providing includes forming an air input conduit and the step of pumping includes:

connecting a first end of the air input conduit to a lower region of the bag so that air traveling through the conduit can enter a region between the two lower plies; and connecting a second end of the air input conduit to a source of pressurized air.

8. The method of claim [1] *9* wherein the step of allowing is performed when the contents have reached a predetermined level.

23. The method of claim [22] *27* wherein the step of inflating occurs automatically when a pressure exerted on the inner ply by the pressurized air is greater than a pressure exerted on the inner ply by the bulk material.

24. The method of claim [22] *27* wherein the bag is a pillow bag comprising at least two top plies and at least two bottom plies, the top and bottom plies being joined at edges of the plies, and the region is between two of the bottom plies.

25. The method of claim [22] *27* wherein the step of connecting includes connecting an air input conduit to a source of pressurized air, the conduit being attached to the bag so that the pressurized air can penetrate to the region between the two plies.

26. The method of claim [22] *27* wherein the bag is a pillow bag with an equator at which edges of at least two upper plies of the pillow bag are joined to respective edges of at least two lower plies and the region is between two of the at least two lower plies.

46. In a bulk material shipping container lined with a pillow bag having a drain for withdrawing semi-fluid contents from the bag, a method of keeping the drain flooded with contents being withdrawn, for more completely emptying the bag, the method comprising:

a. applying low pressure air to an interply region of the bag extending below an equator seam of the bag and below the contents within the bag; and b. prearranging the bag within the container to provide ballooning room *in the container* opposite the drain for the interply region so that as a contents level within the bag lowers, air pressure balloons the interply region of the bag opposite the drain and displaces the contents toward the drain and keeps the drain flooded with the contents until the bag is nearly empty.

50. The method of claim [22] *27* wherein:

the plies have top, bottom, and side edges;

all plies are bonded along each side edge from top to bottom;

all plies are bonded along non-intersecting diagonal seams extending from a point along respective side edges to respective points along the top edge, the diagonal seams defining edges of an integral filling conduit of the bag; and a mouth of the integral filling conduit along a portion of the top edge extending between the points at which the diagonal seams meet the top edge, the mouth including back layers of material bonded to each other and front layers of material bonded to each other.

*53. An arrangement enhancing output of viscous, flow-resistant fluid contents of a bag including:*

*an air input port formed on a multiple-ply bag, the multiple-ply bag including a plurality of plies of substantially identical perimetral extent, at least one edge of each ply being joined to at least one respective edge of another ply, the air input port being connectable to a source of pressurized air;*

*an interply region between two plies of the plurality of plies of the bag with which the air input port is in fluid communication so that the interply region can fill with pressurized air from the source of pressurized air when the source of pressurized air is connected to the air input port;*

*a drain extending from an interior of the bag to an exterior of the bag allowing the contents of the bag to be emptied when present;*

*a portion of the bag acting as a bottom of the bag; and*

*an inner of the two plies having a bottom part at least partially overlying and contacting the bottom of the bag and being configured and arranged so that pressurized air in the interply region pulls the bottom part off the bottom of the bag and forms an increasing portion of the bottom part of the inner ply becoming a wall part of the inner ply substantially non-parallel to the bottom of the bag to increase a depth of the viscous, flow-resistant fluid contents remaining in the bag.*

*54. The arrangement of claim 53, wherein the drain is located at a bottom peripheral portion of the bag.*

*55. The arrangement of claim 53, wherein the increase in depth is characterized by keeping the level of the bulk material above the drain until at least very near the end of evacuation.*

*56. A method of enhancing drainage of viscous, flow-resistant fluid contents of a multiple-ply bag, the bag including at least two plies all of substantially identical dimension defining an interply region, the method including the steps of:*

*inflating the interply region with a source of pressurized air;*

*pulling an inner ply of two plies of the bag as a result of inflation of the interply region;*

*changing the pulled part of the inner ply from being part of the bottom of the bag to being a movable wall, a portion of which is substantially perpendicular to the bottom of the bag;*

*moving the movable wall toward a drainage port of the bag; and*

*raising the level of the viscous, flow-resistant fluid contents of the bag toward the drainage port by movement of the moveable wall.*

*57. The method of claim 56, wherein the drain is located at a bottom peripheral portion of the bag.*

*58. The method of claim 56, wherein increasing the depth comprises keeping the level of the bulk material above the drain until at least very near the end of evacuation.*

*59. The method of claim 56, wherein the bag includes a bottom, and the inner ply is constructed and arranged to overlie and contact the bottom of the bag at least prior to pulling the inner ply.*

* * * * *